US010744756B2

(12) United States Patent
Gohda et al.

(10) Patent No.: US 10,744,756 B2
(45) Date of Patent: Aug. 18, 2020

(54) CONVEYANCE DEVICE, CONVEYANCE SYSTEM, AND HEAD UNIT CONTROL METHOD

(71) Applicants: Mitsunobu Gohda, Kanagawa (JP); Tomoaki Hayashi, Tokyo (JP); Masahiro Mizuno, Kanagawa (JP); Tsuyoshi Nagasu, Kanagawa (JP); Koichi Kudo, Kanagawa (JP); Masayuki Sunaoshi, Ibaraki (JP)

(72) Inventors: Mitsunobu Gohda, Kanagawa (JP); Tomoaki Hayashi, Tokyo (JP); Masahiro Mizuno, Kanagawa (JP); Tsuyoshi Nagasu, Kanagawa (JP); Koichi Kudo, Kanagawa (JP); Masayuki Sunaoshi, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/926,895

(22) Filed: Mar. 20, 2018

(65) Prior Publication Data

US 2018/0272694 A1 Sep. 27, 2018

(30) Foreign Application Priority Data

Mar. 21, 2017 (JP) ..... 2017-054171
Mar. 16, 2018 (JP) ..... 2018-050038

(51) Int. Cl.
*B41J 2/045* (2006.01)
*B41J 11/42* (2006.01)
(Continued)

(52) U.S. Cl.
CPC ..... *B41J 2/04505* (2013.01); *B41J 2/04503* (2013.01); *B41J 2/04573* (2013.01);
(Continued)

(58) Field of Classification Search
CPC . B41J 15/04; B41J 29/393; B41J 11/42; B41J 2/2146; B41J 11/0095; B41J 29/38;
(Continued)

(56) References Cited

U.S. PATENT DOCUMENTS 8,172,357 B2 * 5/2012 Enomoto ..... B41J 2/2146 347/19
2002/0081132 A1 6/2002 Miyamoto et al.
(Continued)

FOREIGN PATENT DOCUMENTS

JP 2015-064324 4/2015

*Primary Examiner* — Jannelle M Lebron
(74) *Attorney, Agent, or Firm* — Duft & Bornsen, PC

(57) ABSTRACT

A conveyance device includes a conveyor to convey a conveyed object, a head unit to perform an operation on the conveyed object being conveyed at a first conveyance speed, a sensor to acquire data of the conveyed object, a gauge to output a measured travel amount of the conveyed object, and a processor. The processor includes a calculator to calculate a detection result including at least one of a position, a speed of travel, and a calculated travel amount of the conveyed object based on the data acquired by the sensor; and an adjusting unit to adjust a timing of acquisition of the data acquired while the conveyed object is conveyed at the first conveyance speed, based on the detection result and the measured travel amount of the conveyed object being conveyed at a second conveyance speed lower than the first conveyance speed.

15 Claims, 24 Drawing Sheets

(51) Int. Cl.
*B41J 11/00* (2006.01)
*B41J 2/21* (2006.01)
*B41J 25/00* (2006.01)

(52) U.S. Cl.
CPC ..... *B41J 2/04586* (2013.01); *B41J 2/2146* (2013.01); *B41J 11/0095* (2013.01); *B41J 11/42* (2013.01); *B41J 25/001* (2013.01); *B41J 2025/008* (2013.01)

(58) Field of Classification Search
CPC .... B41J 11/46; B41J 2/04586; B41J 2/04505; B41J 2/04573; B41J 2025/008; B41J 2/04503; B41J 25/001
USPC ..... 347/5, 9, 14, 16, 19, 104
See application file for complete search history.

(56) References Cited

U.S. PATENT DOCUMENTS

2002/0131804 A1 9/2002 Nakazawa et al.
2003/0039496 A1 2/2003 Miyamoto et al.
2005/0174379 A1 8/2005 Nakazawa et al.
2010/0310284 A1 12/2010 Funato et al.
2014/0044460 A1 2/2014 Kudo et al.
2014/0219670 A1 8/2014 Masuda et al.
2014/0268180 A1 9/2014 Takaura et al.
2015/0009262 A1 1/2015 Bell et al.
2016/0031209 A1* 2/2016 Morizono ..... B41J 2/04573 347/9
2016/0075157 A1 3/2016 Morinaga et al.
2016/0114576 A1 4/2016 Tobita
2016/0121602 A1 5/2016 Nagasu et al.
2016/0136947 A1 5/2016 Hommi
2016/0347050 A1 12/2016 Hommi
2017/0106647 A1 4/2017 Inoue
2017/0165960 A1 6/2017 Sunaoshi et al.
2017/0165961 A1 6/2017 Hayashi et al.
2017/0182764 A1 6/2017 Nagasu et al.
2017/0266954 A1 9/2017 Nagasu et al.
2017/0266965 A1 9/2017 Gohda et al.
2017/0348969 A1 12/2017 Chiba
2017/0355205 A1 12/2017 Tobita et al.
2018/0022088 A1 1/2018 Bando et al.

* cited by examiner

CONVEYANCE DEVICE, CONVEYANCE SYSTEM, AND HEAD UNIT CONTROL METHOD

CROSS-REFERENCE TO RELATED APPLICATIONS

This patent application is based on and claims priority pursuant to 35 U.S.C. § 119(a) to Japanese Patent Application Nos. 2017-054171 filed on Mar. 21, 2017, and 2018-050038 filed on Mar. 16, 2018, in the Japan Patent Office, the entire disclosure of each of which is hereby incorporated by reference herein.

BACKGROUND

Technical Field

This disclosure relates to a conveyance device, a conveyance system, and a method for controlling a head unit.

Description of the Related Art

There are various types of operation using a head unit. For example, there are image forming methods that include discharging ink from a print head (so-called inkjet method). To improve the quality of images formed on recording media, such image forming methods include, for example, adjusting the position of the print head relative to the recording media.

For example, to improve image quality, the position of the print head is adjusted. For example, there is a method for detecting fluctuations in position of a recording medium (e.g., a web) conveyed through a print system for printing on continuous sheets. Specifically, a sensor detects fluctuations in position of the recording medium in a lateral direction of the recording medium orthogonal to the direction in which the recording medium is conveyed. The position of the print head in the lateral direction is adjusted to compensate for the fluctuations in position detected by the sensor.

SUMMARY

According to an embodiment of this disclosure, a conveyance device includes a conveyor to convey a conveyed object in a conveyance direction, at least one head unit to perform an operation on the conveyed object being conveyed at a first conveyance speed, a sensor to acquire data of the conveyed object, provided for each of the at least one head unit, a gauge to output a measured travel amount of the conveyed object, and at least one processor. The processor includes a calculator configured to calculate a detection result including at least one of a position, a speed of travel, and a calculated travel amount of the conveyed object based on the data acquired by the sensor. The processor further includes an adjusting unit configured to adjust a timing of acquisition of the data acquired while the conveyed object is conveyed at the first conveyance speed. The adjusting adjusts the timing of acquisition of the data based on the detection result and the measured travel amount of the conveyed object being conveyed at a second conveyance speed lower than the first conveyance speed.

According to another embodiment, a conveyance system includes a plurality of conveyance devices. Each of the plurality of conveyance devices includes the conveyor, at least one head unit, the sensor, the gauge, and the processor described above.

Yet another embodiment provides a method for controlling a head unit to perform an operation on a conveyed object being conveyed. The method includes acquiring data of the conveyed object with a sensor; calculating a detection result including at least one of a position, a speed of travel, and a calculated travel amount of the conveyed object based on data acquired by the sensor; outputting a measured travel amount of the conveyed object; and adjusting, based on the detection result and the measured travel amount, a timing of acquisition of the data.

BRIEF DESCRIPTION OF THE DRAWINGS

A more complete appreciation of the disclosure and many of the attendant advantages thereof will be readily acquired as the same becomes better understood by reference to the following detailed description when considered in connection with the accompanying drawings, wherein.

Figure 1:
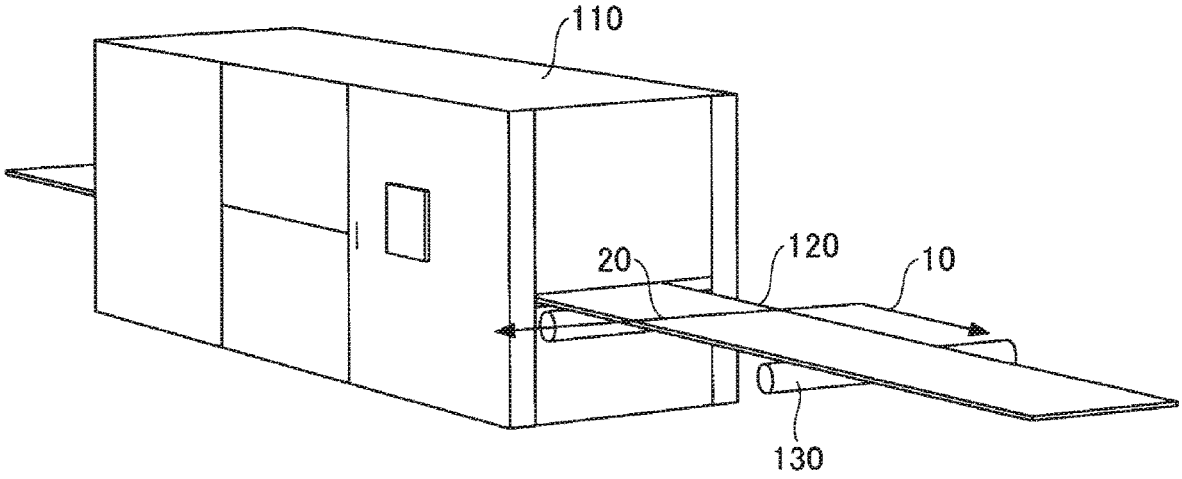
FIG. 1 is a schematic view of a liquid discharge apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, a conveyance device including a head unit, according to an embodiment of this disclosure, is described. As used herein, the singular forms "a", "an", and "the" are intended to include the plural forms as well, unless the context clearly indicates otherwise.

The suffixes Y, M, C, and K attached to each reference numeral indicate only that components indicated thereby are used for forming yellow, magenta, cyan, and black images, respectively, and hereinafter may be omitted when color discrimination is not necessary.

General Configuration

Descriptions are given below of an embodiment in which a head unit of a conveyance device is a liquid discharge head unit, and an operation position is a position at which processing is made on a web (a recording medium) with liquid discharged from the liquid discharge head unit. When the head unit of the conveyance device is a liquid discharge head unit to discharge liquid, the conveyance device is a liquid discharge apparatus.

FIG. 1 is a schematic view of a liquid discharge apparatus according to an embodiment. The liquid discharge apparatus discharges recording liquid such as aqueous ink or oil-based ink. Descriptions of embodiments are given below using an image forming apparatus as an example of the liquid discharge apparatus.

A liquid discharge apparatus 110 illustrated in FIG. 1 conveys a conveyed object such as a web 120. In the illustrated example, the liquid discharge apparatus 110 includes a roller 130 and the like to convey the web 120, and discharges liquid onto the web 120 to form an image thereon. When an image is formed on the web 120 (i.e., a conveyed object), the web 120 is considered as a recording medium. The web 120 is a so-called continuous sheet. That is, the web 120 is, for example, a rolled sheet to be reeled.

For example, the liquid discharge apparatus 110 is a so-called production printer. The description below concerns an example in which the roller 130 adjusts the tension of the web 120 and conveys the web 120 in a conveyance direction 10. Hereinafter, unless otherwise specified, "upstream" and "downstream" mean those in the conveyance direction 10. A direction orthogonal to the conveyance direction 10 is referred to as an orthogonal direction 20 (e.g., a width direction of the web 120). In the illustrated example, the liquid discharge apparatus 110 is an inkjet printer to discharge four color inks, namely, black (K), cyan (C), magenta (M), and yellow (Y) inks, to form an image on the web 120.

Figure 2:
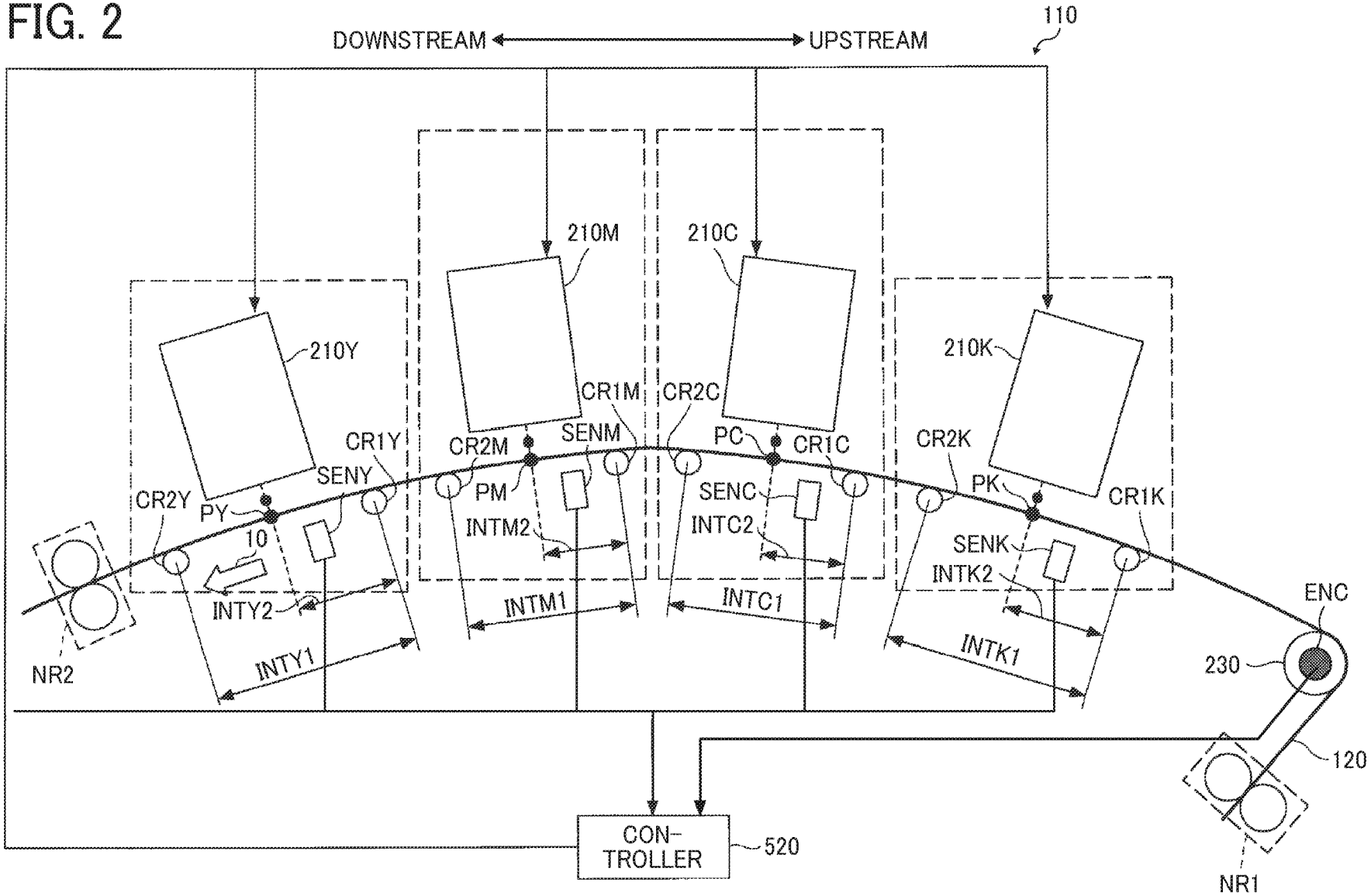
FIG. 2 is a schematic view illustrating a general structure of the liquid discharge apparatus illustrated in FIG. 1.

FIG. 2 is a schematic view illustrating a general structure of a liquid discharge apparatus according to an embodiment. As illustrated in FIG. 2, the liquid discharge apparatus 110 includes four liquid discharge head units 210 (210Y, 210M, 210C, and 210K) to discharge the four inks, respectively.

Each liquid discharge head unit 210 discharges the ink onto the web 120 conveyed in the conveyance direction 10. The liquid discharge apparatus 110 includes two pairs of nip rollers, a roller 230, and the like, to convey the web 120. One of the two pairs of nip rollers is a first nip roller pair NR1 disposed upstream from the liquid discharge head units 210 in the conveyance direction 10. The other is a second nip roller pair NR2 disposed downstream from the first nip roller pair NR1 and the liquid discharge head units 210 in the conveyance direction 10. Each nip roller pair rotates while nipping the conveyed object, such as the web 120, as illustrated in FIG. 2. The nip roller pairs and the roller 230 together serve as a conveyor to convey the conveyed object (e.g., the web 120) in a predetermined direction.

The liquid discharge apparatus 110 further includes a gauge, such as an encoder ENC, to measure the amount by which the web 120 is conveyed by the roller 230 and the like. Specifically, the encoder ENC includes a rotary plate and a rotation sensor to read surface data on the rotary plate. For example, the rotary plate of the encoder ENC is attached to the rotation shaft of the roller 230. As the roller 230 rotates, the rotary plate rotates, and the rotation sensor outputs an encoder pulse ENP corresponding to the amount of rotation of the rotary plate. The gauge is not limited to the encoder ENC, but can be any gauge capable of measuring the amount of movement. As long as the amount of movement is measured, the gauge can be disposed differently from the position illustrated.

The recording medium such as the web 120 is preferably a long sheet. Specifically, the recording medium is preferably longer than the distance between the first nip roller pair NR1 and the second nip roller pair NR2. The recording medium is not limited to webs. For example, the recording medium can be a folded sheet (so-called fanfold paper or Z-fold paper).

In the structure illustrated in FIG. 2, the liquid discharge head units 210 are arranged in the order of black, cyan, magenta, and yellow in the conveyance direction 10. Specifically, a liquid discharge head unit 210K for black is disposed extreme upstream, and a liquid discharge head unit 210C for cyan is disposed next to the liquid discharge head unit 210K. Further, the liquid discharge head unit 210M for magenta is disposed next to the liquid discharge head unit 210C for cyan, and the liquid discharge head unit 210Y for yellow is disposed extreme downstream in the conveyance direction 10.

Each liquid discharge head unit 210 discharges the ink to a predetermined position on the web 120, according to image data. The position where the ink lands on the web 120 (hereinafter "landing position") is approximately directly below the position at which the liquid discharge head unit 210 discharges liquid (hereinafter "ink discharge position"). In the description below, the ink discharge position serves as an operation position on the conveyed object, on which the liquid discharge head unit 210 performs processing. Since the position of discharge of liquid to the conveyed object is identical or almost identical to the landing position, which is directly below the head unit, the term "landing position" may be used as the operation position in the descriptions below.

In the present embodiment, black ink is discharged to the ink landing position of the liquid discharge head unit 210K (hereinafter "black landing position PK"). Similarly, cyan ink is discharged to the ink landing position of the liquid discharge head unit 210C (hereinafter "cyan landing position PC"). Magenta ink is discharged to the ink landing position of the liquid discharge head unit 210M (hereinafter "magenta landing position PM"). Yellow ink is discharged to the ink landing position of the liquid discharge head unit 210Y (hereinafter "yellow landing position PY").

In the description below, the timing of operation by the head unit is referred to as "operation timing". Specifically, for example, a controller 520 operably connected to the liquid discharge head units 210 controls the respective timings of ink discharge of the liquid discharge head units 210 and actuators ACTY, ACTM, ACTC, and ACTK (collectively "actuators ACT") illustrated in FIG. 4, to move the liquid discharge head units 210. In one embodiment, the timing control and the actuator control is performed by two or more controllers (or control circuits). The actuators ACT are to be described later. In the illustrated structure, each liquid discharge head unit 210 is provided with a plurality of rollers. As illustrated in the drawings, for example, the liquid discharge apparatus 110 includes the rollers respectively disposed upstream and downstream from each liquid discharge head unit 210. Specifically, each liquid discharge head unit 210 is provided with one roller (i.e., a first roller) to support the web 120, disposed upstream from the ink landing position and another roller (i.e., a second roller) to support the web 120, disposed downstream from the ink landing position, in the conveyance passage along which the web 120 is conveyed.

Disposing the first roller and the second roller for each ink landing position can suppress fluttering of the recording medium conveyed. For example, the first roller and the second roller are disposed along the conveyance passage of the recording medium and, for example, are driven rollers. Alternatively, the first roller and the second roller may be driven by a motor or the like.

Note that, instead of the first and second rollers that are rotators such as driven rollers, first and second supports that are not rotatable to support the conveyed object can be used. For example, each of the first and second supports can be a pipe or a shaft having a round cross section. Alternatively, each of the first and second supports can be a curved plate having an arc-shaped face to contact the conveyed object. In the description below, the first and second supporters are rollers.

Specifically, a first roller CR1K is disposed upstream from the black ink landing position PK in the conveyance direction 10 in which the web 120 is conveyed. A second roller CR2K is disposed downstream from the black ink landing position PK in the conveyance direction 10.

Similarly, a first roller CR1C and a second roller CR2C are disposed upstream and downstream from the liquid discharge head unit 210C for cyan, respectively. Similarly, a first roller CR1M and a second roller CR2M are disposed upstream and downstream from the liquid discharge head unit 210M, respectively. Similarly, a first roller CR1Y and a second roller CR2Y are disposed upstream and downstream from the liquid discharge head unit 210Y, respectively.

Figure 3A:
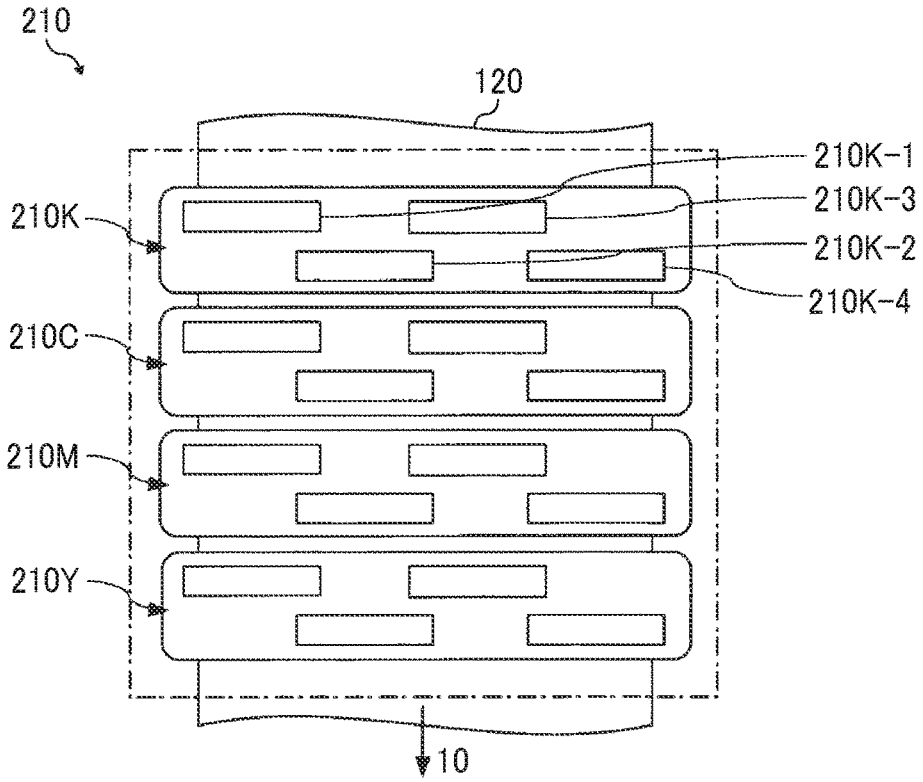
FIGS. 3A and 3B are schematic views illustrating an external shape of a liquid discharge head unit according to an embodiment.
Figure 3B:
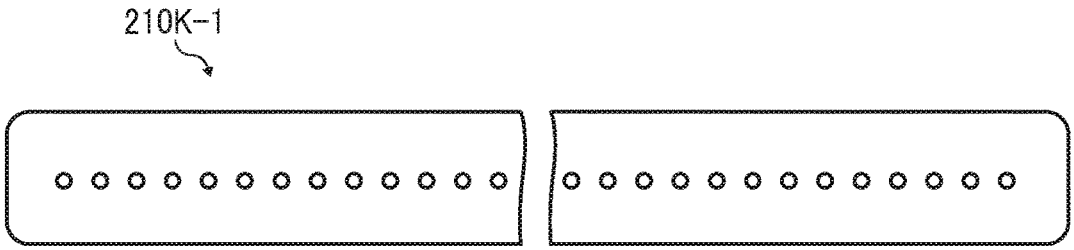

FIGS. 3A and 3B are schematic views illustrating external shapes of the liquid discharge head unit according to the present embodiment. FIG. 3A is a schematic plane view of one of the four liquid discharge head units 210K to 210Y of the liquid discharge apparatus 110.

In the example illustrated in FIG. 3A, the liquid discharge head unit 210 is a line head unit. That is, the liquid discharge apparatus 110 includes the four liquid discharge head units 210K, 210C, 210M, and 210Y arranged in the order of black, cyan, magenta, and yellow in the conveyance direction 10.

In this example, the liquid discharge head unit 210K includes four heads 210K-1, 210K-2, 210K-3, and 210K-4 arranged in a staggered manner in the orthogonal direction 20. With this arrangement, the liquid discharge apparatus 110 can form an image throughout the image formation area on the web 120 in the width direction orthogonal to the conveyance direction 10. The liquid discharge head units 210C, 210M, and 210Y are similar in structure to the liquid discharge head unit 210K, and the descriptions thereof are omitted to avoid redundancy.

Although the description above concerns a liquid discharge head unit including four heads, a liquid discharge head unit including a single head can be used.

[Detecting Unit]

The liquid discharge apparatus 110 includes, for example, a sensor device (e.g., sensor devices SENK, SENC, SENM, or SENY, also collectively "sensor devices SEN") for each liquid discharge head unit, as illustrated in FIG. 2 as example hardware to implement a detecting function (a detecting unit described later) of the liquid discharge apparatus 110. The term "sensor device" in this specification means a unit constructed of components including a sensor capable of acquiring data of the web 120. Based on the data acquired by the sensor, the liquid discharge apparatus 110 detects the position of the recording medium in the conveyance direction 10, the orthogonal direction 20, or both. The liquid discharge apparatus 110 can further include another sensor device separate from the sensor devices SEN illustrated in the drawings. For example, another sensor can be disposed upstream from the illustrated sensor devices SEN in the conveyance direction 10. A description is given below of an example where the liquid discharge apparatus 110 includes four sensor devices SEN. The structures and locations of the sensor devices are not limited to those illustrated in the drawings.

Referring back to FIG. 2, in the description below, the sensor device SEN including the sensor corresponding to the liquid discharge head unit 210K for black is referred to as "sensor device SENK". Similarly, the sensor device SEN provided for the liquid discharge head unit 210C for cyan is referred to as "sensor device SENC". The sensor device provided for the liquid discharge head unit 210M for magenta is referred to as "sensor device SENM". The sensor device provided for the liquid discharge head unit 210Y for yellow is referred to as "sensor device SENY". In the description below, the sensor devices SENK, SENC, SENM, and SENY may be collectively referred to as "sensor devices SEN" or "sensor devices".

Further, the term "location of sensor" means the position where data acquisition and the like are performed. Accordingly, it is not necessary that all components relating to the detection are disposed at the "location of sensor". In one embodiment, components for functions other than acquisition of data of the web 120 are coupled to the sensor via a cable and disposed away therefrom. In FIG. 2, references "SENK, SENC, SENM, and SENY" are given at respective example locations of sensor devices in the liquid discharge apparatus 110.

Preferably, the location of sensor is close to the landing position of ink. That is, the distance between the landing position of ink and the sensor is preferably short. When the distance between the ink landing position and the sensor is short, detection error can be suppressed. Accordingly, the liquid discharge apparatus 110 can detect, with the sensor, the position of the conveyed object accurately.

Specifically, the position close to the landing position is, for example, an area between the first roller CR1 and the second roller CR2. In the illustrative embodiment, the sensor device SENK for black is preferably disposed in an inter-roller range INTK1 between the first and second rollers CR1K and CR2K. Similarly, the sensor device SENC for cyan is preferably disposed in an inter-roller range INTC1 between the first and second rollers CR1C and CR2C. The sensor device SENM for magenta is preferably disposed in an inter-roller range INTM1 between the first and second rollers CR1M and CR2M. The sensor device SENY for yellow is preferably disposed in an inter-roller range INTY1 between the first and second rollers CR1Y and CR2Y. The inter-roller ranges INTY1, INTC1, INTM1, and INTY1 are collectively referred to as "inter-roller ranges INT1".

The sensor disposed between the first and second rollers CR1 and CR2 can detect the recording medium at a position close to the ink landing position. The conveyance speed in the conveyance direction 10 and the speed of meandering (the speed of movement in the orthogonal direction 20) of the conveyed object is relatively stable between the rollers. Accordingly, the liquid discharge apparatus 110 can detect the position of the conveyed object accurately.

More preferably, in each inter-roller ranges INT1, the sensor is disposed between the ink landing position and the first roller CR1. In other words, the sensor device SEN is preferably disposed upstream from the ink landing position in the conveyance direction 10.

Specifically, the sensor device SENK for black is, more preferably, disposed in a range extending from the black ink landing position PK upstream to the first roller CR1K for black in the conveyance direction 10 (hereinafter "upstream range INTK2"). Similarly, the sensor device SENC for cyan is, more preferably, disposed in a range extending from the cyan ink landing position PC upstream to the first roller CR1C for cyan (hereinafter "upstream range INTC2"). The sensor device SENM for magenta is, more preferably, disposed in a range extending from the magenta ink landing position PM upstream to the first roller CR1M for magenta (hereinafter "upstream range INTM2"). The sensor device SENY for yellow is, more preferably, disposed in a range extending from the yellow ink landing position PY upstream to the first roller CR1Y for yellow (hereinafter "upstream range INTY2").

When the sensor devices SEN are respectively disposed in the upstream ranges INTK2, INTC2, INTM2, and INTY2, the liquid discharge apparatus 110 can detect the recording medium (conveyed object) with a high accuracy.

The sensor thus disposed is upstream from the ink landing position in the conveyance direction 10. Therefore, the liquid discharge apparatus 110 can accurately detect, with the sensor device SEN, the position of the recording medium in the conveyance direction 10, the orthogonal direction 20, or both, on the upstream side. Accordingly, the liquid discharge apparatus 110 can calculate respective ink discharge timings (i.e., operation timings) of the liquid discharge head units 210, the amount by which the head unit is to move (i.e., head moving amount), or both. In other words, in a period from when the position of a given portion of the web 120 is detected on the upstream side of the droplet landing position to when the detected portion of the web 120 reaches the droplet landing position, the operation timing is calculated or the head unit is moved. Therefore, the liquid discharge apparatus 110 can change the droplet landing position with high accuracy.

Note that, assuming that the sensor device SEN is disposed directly below the liquid discharge head unit 210, in some cases, a delay of control action renders an image out of color registration. Accordingly, when the location of sensor is upstream from the ink landing position, misalignment in color superimposition is suppressed, improving image quality. There are cases where layout constraints hinder disposing the sensor device SEN adjacent to the droplet landing position. Accordingly, the sensor is preferably disposed closer to the first roller CR1 than the ink landing position.

When such delay of control action does not matter and there is no layout constraint, the location of sensor device can be directly below the liquid discharge head unit 210. The sensor disposed directly below the head unit can accurately detect the amount of movement of the recording medium directly below the head unit. Therefore, in a configuration in which the speed of control action is relatively fast, the sensor is preferably disposed closer to the position directly below the liquid discharge head unit 210. However, the location of sensor is not limited to a position directly below the liquid discharge head unit 210, and similar calculation is feasible when the sensor is disposed otherwise.

Alternatively, in a configuration in which error is tolerable, the sensor can be disposed directly below the liquid discharge head unit 210, or between the first and second rollers and downstream from the position directly below the liquid discharge head unit 210.

Figure 4:
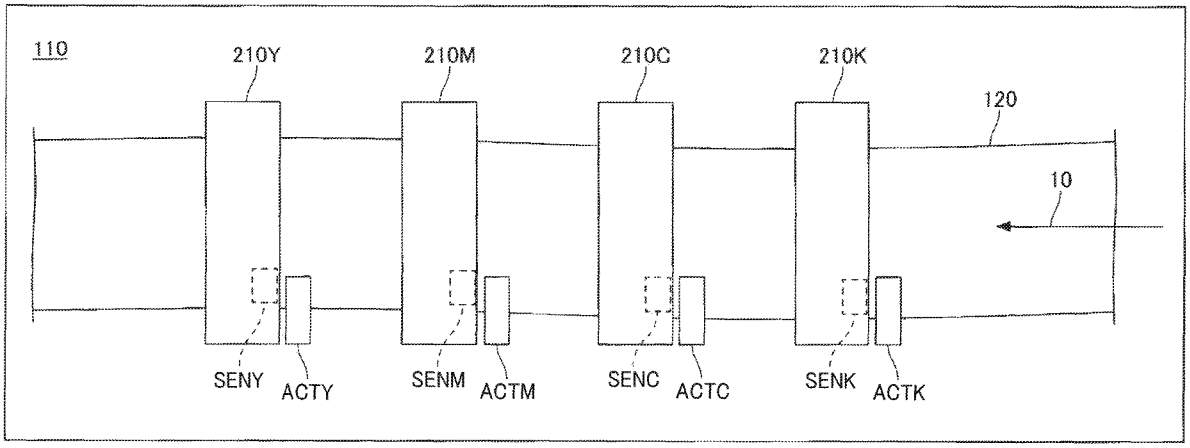
FIG. 4 is a plan view of sensors of a liquid discharge apparatus according to an embodiment, for understanding of arrangement of sensors.

FIG. 4 is a plan view illustrating example placement of the sensors of the liquid discharge apparatus 110. For example, the sensor is disposed to detect a surface of the web 120 as illustrated in the drawing.

The sensor devices SEN are disposed facing the liquid discharge head units 210, respectively, via the web 120. Each sensor device SEN includes, for example, a light-emitting element to emit light (e.g., laser light) onto the web 120 and an image sensor to image a range of the web 120 irradiated with the light emitted from the light-emitting element.

Additionally, in this structure, the liquid discharge head unit 210 and the sensor device SEN are preferably disposed such that the operation area (e.g., the image formation area) of the liquid discharge head unit 210 overlaps, at least partly, with the detection area of the sensor device SEN. The actuators ACTK, ACTC, ACTM, and ACTY (also collectively "actuators ACT") move the corresponding head units 210 in the direction orthogonal to the conveyance direction 10. The actuators ACT are to be described later.

Hardware Configuration

Sensors usable for the sensor devices SEN include an optical sensor employing light such as infrared and a sensor employing laser, air pressure, photoelectric, or ultrasonic. For example, the optical sensor is a charge-coupled device (CCD) camera or a complementary metal oxide semiconductor (CMOS) camera.

Preferably, the optical sensor employs a global shutter. A global shutter is advantageous in that, even if the speed of movement is fast, the optical sensor can reduce a deviation in image, caused by untimely shutter releasing. An example structure of the sensor is described below. The optical sensor is a sensor capable of acquiring data on the surface of the recording medium. Note that the sensor devices can be of same type or different types. In the description below, the sensor devices are of same type. The description below concerns an example in which the sensor is an optical sensor.

Figure 5:
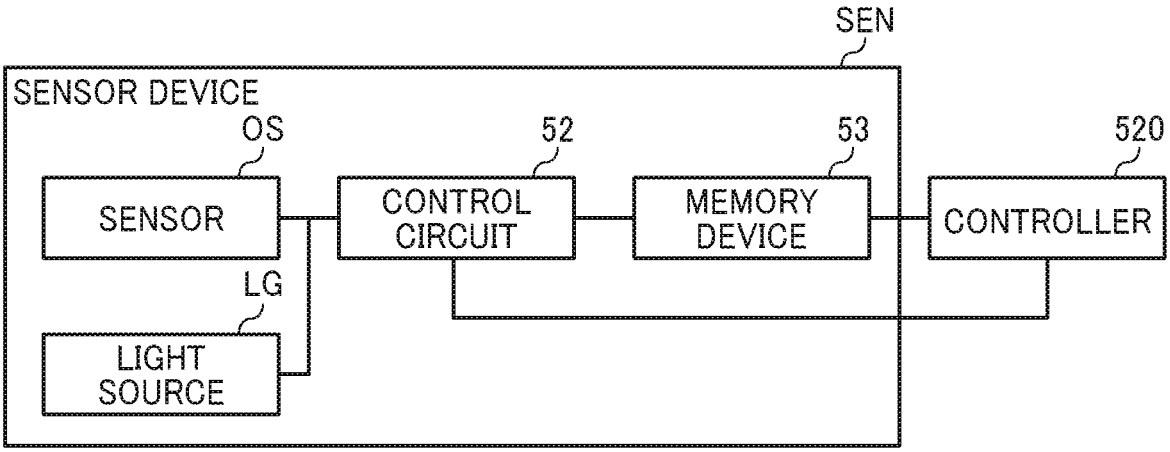
FIG. 5 is a schematic block diagram illustrating a hardware configuration of a conveyed object detector according to an embodiment.

FIG. 5 is a schematic hardware block diagram to implement the functions including the detection unit, according to the present embodiment. For example, the detecting unit is implemented by hardware such as the sensor devices SEN and connected to hardware such as the controller 520, illustrated in FIGS. 2 and 5.

The sensor device SEN is described below.

Figure 6:
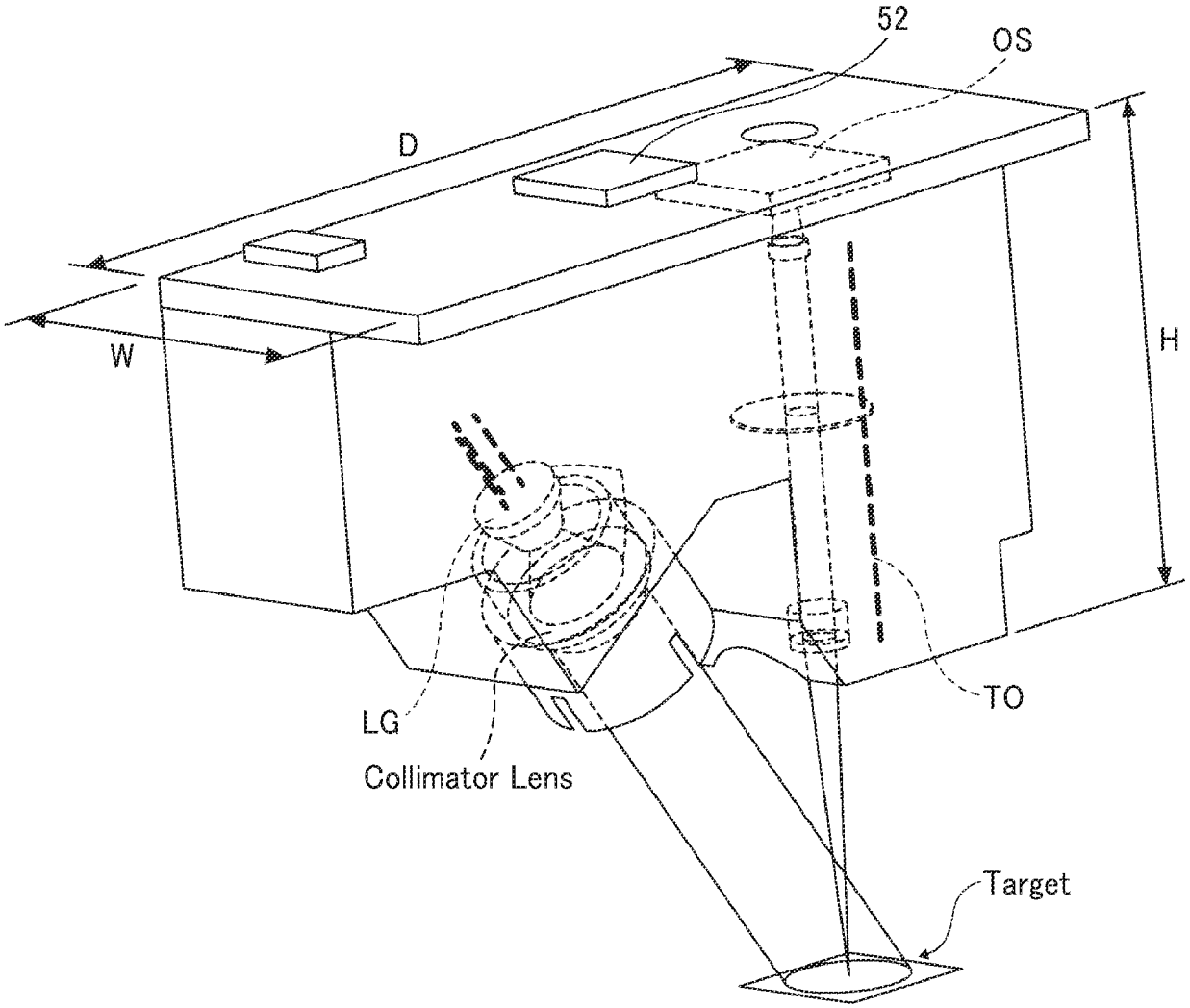
FIG. 6 is an external view of a sensor device according to an embodiment.

FIG. 6 is an external view of the sensor device SEN according to the present embodiment.

The sensor device SEN is configured to capture a speckle pattern, which appears on a conveyed object (i.e., a target in FIG. 6) such as the web 120 when the conveyed object is irradiated with light. Specifically, the sensor device SEN includes a light source LG such as a semiconductor laser light source (e.g., a laser diode or LD) and an optical system such as a collimate optical system. To acquire an image of the speckle pattern, the sensor device SEN includes a sensor OS (a CMOS image sensor) and a telecentric optics (TO) to condense light to image the speckle pattern on the sensor OS. The speckle pattern is described later.

In the illustrated structure, the CMOS image sensors (the sensors OS) of different sensor devices SEN capture the image of the speckle pattern, for example, at a time TM1 and a time TM2, respectively. Based on the image acquired at the time TM1 and the image acquired at the time TM2, the controller 520 performs cross-correlation operation. In this case, for example, the amount by which the conveyed object has actually moved from the time TM1 to the TM2, from one sensor device SEN toward the other sensor device SEN, can be calculated. Details are to be described later. Alternatively, the CMOS image sensor can capture the speckle pattern at the time TM1 and at the time TM2, and the cross-correlation operation can be made using the image of the speckle pattern captured at the time TM1 and that captured at the time TM2. In this case, the controller 520 can output the amount of movement of the conveyed object from the time TM1 to the time TM2. In the illustrated example, the sensor device SN has a width W of 15 mm, a depth D of 60 mm, and a height H of 32 mm (15×60×32). The light source is not limited to laser light sources but can be, for example, a light emitting diode (LED) or an organic electro luminescence (EL). Depending on the type of light source, the pattern to be detected is not limited to the speckle pattern. Descriptions are given below of an example in which the pattern indicating the surface data is a speckle pattern. The CMOS image sensor (the sensor OS) is an example hardware structure to implement an imaging unit 16 (16A or 16B) to be described later. Although the controller 520 performs the correlation operation in this example, in one embodiment, a field-programmable gate array (FPGA) circuit of one of the sensor devices SEN performs the correlation operation.

The control circuit 52 controls the sensor OS, the light source LG, and the like inside the sensor device SEN. Specifically, the control circuit 52 outputs trigger signals to the sensor OS to control the shutter timing of the sensor OS. The control circuit 52 causes the sensor OS to generate the two-dimensional images and acquires the two-dimensional images therefrom. Then, the control circuit 52 transmits the two-dimensional images generated by the sensor OS to the memory device 53. In another embodiment, the control circuit 52 is implemented by the FPGA circuit, for example.

The memory device 53 is a so-called memory. It is preferable that the two-dimensional image transmitted from the control circuit 52 can be divided and the memory device 53 can store the divided images in different memory ranges.

The controller 520 performs operations using the image data stored in the memory device 53.

The control circuit 52 and the controller 520 are, for example, central processing units (CPUs) or electronic circuits. Note that the control circuit 52, the memory device 53, and the controller 520 are not necessarily different devices. For example, the control circuit 52 and the controller 520 can be implemented by a single CPU.

Functional Configuration

Figure 7:
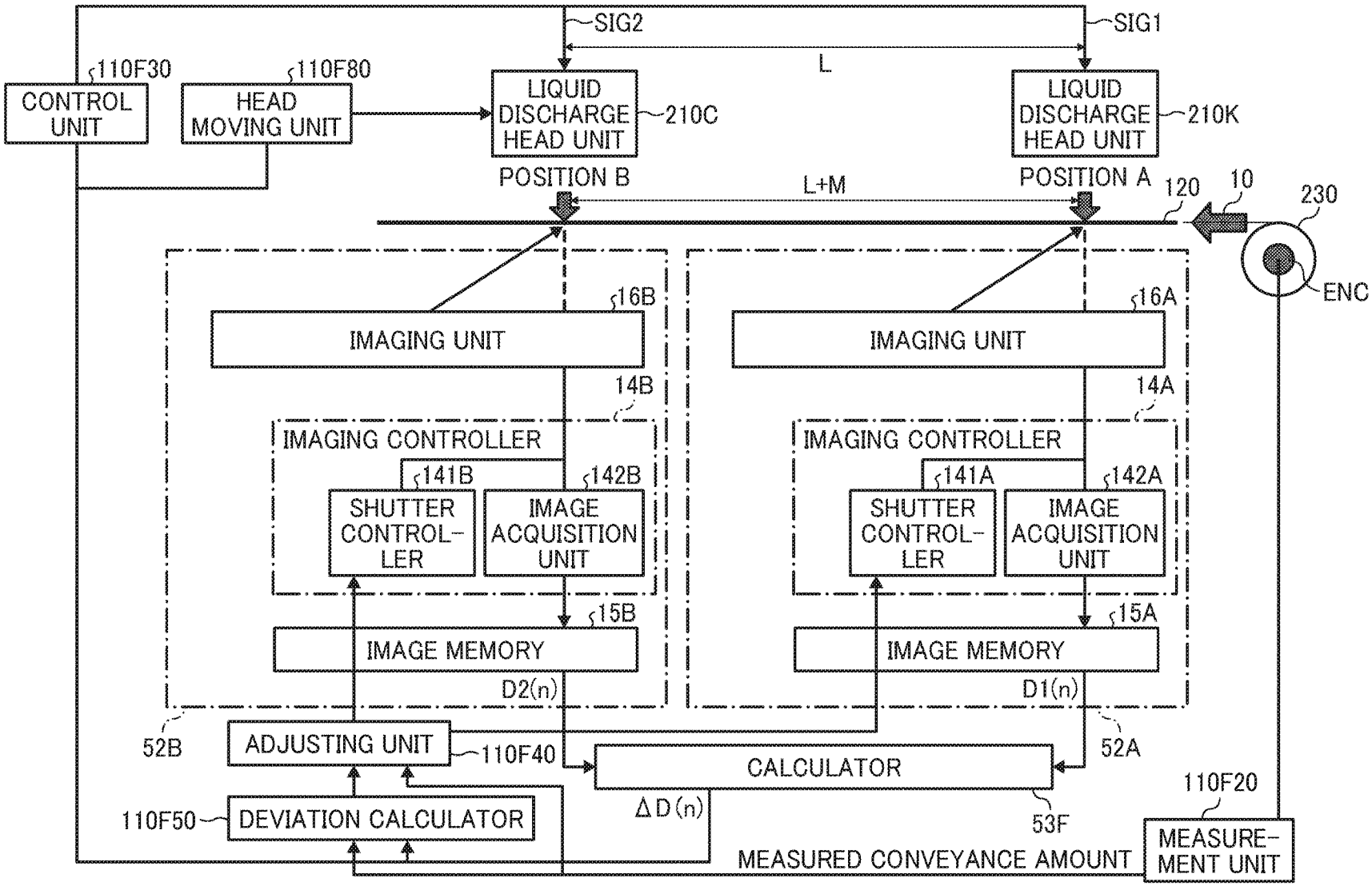
FIG. 7 is a schematic block diagram of a functional configuration of a detecting unit according to an embodiment.

FIG. 7 is a schematic block diagram of a functional configuration according to the present embodiment. Descriptions below are based on a combination of detecting units for the liquid discharge head units 210K and 210C, of the detecting units respectively provided for the liquid discharge head units 210.

In the example illustrated in FIG. 7, a detecting unit 52A for the liquid discharge head unit 210K acquires data concerning the position A, and a detecting unit 52B for the liquid discharge head unit 210C acquires a data concerning the position B. The detecting unit 52A for the liquid discharge head unit 210K includes, for example, an imaging unit 16A, an imaging controller 14A, and an image memory 15A. In this example, the detecting unit 52B for the liquid discharge head unit 210C is similar in configuration to the detecting unit 52A. The detecting unit 52B includes an imaging unit 16B, an imaging controller 14B, and an image memory 15B. The detecting unit 52A is described below.

The imaging unit 16A captures an image of the web 120 conveyed in the conveyance direction 10. The imaging unit 16A is implemented by, for example, the sensor OS (illustrated in FIG. 5).

The imaging controller 14A includes a shutter controller 141A and an image acquisition unit 142A. The imaging controller 14A is implemented by, for example, the control circuit 52 (illustrated in FIG. 5).

The image acquisition unit 142A captures the image generated by the imaging unit 16A.

The shutter controller 141A controls the timing of imaging by the imaging unit 16A.

The image memory 15A stores the image acquired by the imaging controller 14A. The image memory 15A is implemented by, for example, the memory device 53 and the like (illustrated in FIG. 5).

A calculator 53F is configured to calculate, based on the images respectively recorded in the image memories 15A and 15B, the position of a pattern on the web 120, the speed at which the web 120 is conveyed (hereinafter "conveyance speed"), and the amount by which the web 120 is conveyed (hereinafter "conveyance amount" or "travel amount"). The output from the calculator 53F is used in both of the adjustment of the timing of acquisition (described later) and adjustment of operation position to follow the displacement (meandering) of the web 120 during image formation.

A measurement unit 110F20 counts the encoder pulse ENP output from the encoder ENC attached to the roller 230 illustrated in FIG. 2.

A deviation calculator 110F50 is configured to calculate, in the adjustment of timing of acquisition, a deviation amount ΔD relative to the ideal distance L (sensor interval) between the position A and the position B, based on the outputs from the measurement unit 110F20 and the calculator 53F. Such calculation is to be described in detail later.

An adjusting unit 110F40 outputs, to the shutter controllers 141A and 141B, data indicating the timing of shooting (shutter timing) based on either the output from the measurement unit 110F20 or the output from the measurement unit 110F20 and the calculation result by the deviation calculator 110F50, thereby adjusting the timing of acquisition. In other words, the adjusting unit 110F40 instructs the shutter controller 141A of shutter timings of imaging at the position A and imaging at the position B with a predetermined interval. Alternatively, instead of outputting the shutter timing to the shutter controller 141B, the adjusting unit 110F40 can change the image based on which the calculator 53F executes calculation, thereby adjusting the timing of acquisition used to calculate the detection result.

The head moving unit 110F80 is used in the adjustment of operation position to follow the displacement of the web 120 during image formation. The head moving unit 110F80 is configured to move the liquid discharge head unit 210 based on the amount or speed of movement in the orthogonal direction 20 calculated by the calculator 53F. The head moving unit 110F80 is implemented by, for example, the actuator controller CTRC and the actuator. The head moving unit 110F80 is described in detail later.

A control unit 110F30 (a head controller) causes the plurality of liquid discharge head units 210 to discharge respective color liquids. The control unit 110F30 is used in the adjustment of operation position to follow the displacement of the web 120 during image formation. For adjusting the operation position to follow the displacement of the web 120, the control unit 110F30 outputs, for example, a first control signal SIG1 for black and a second control signal SIG2 for cyan to cause the liquid discharge head units 210 to discharge liquid at respective timing determined based on the detection result generated by the calculator 53F.

The calculator 53F, the measurement unit 110F20, the deviation calculator 110F50, the adjusting unit 110F40, and the control unit 110F30 are implemented by, for example, the controller 520 (illustrated in FIG. 2) and the like.

The speckle pattern is described below. The web 120 has diffusiveness on a surface thereof or in an interior thereof. Accordingly, when the web 120 is irradiated with light (e.g., laser beam), the reflected light is diffused. The diffuse reflection creates a pattern on the web 120. The pattern is made of spots called "speckles" (i.e., a speckle pattern). Accordingly, when the web 120 is shot, an image of the speckle pattern is acquired. From the image, the position of the speckle pattern is known, and the location of a specific portion of the web 120 can be detected. The speckle pattern is generated as the light emitted to the web 120 interferes with a rugged shape caused by a projection and a recess, on the surface or inside of the web 120.

As the web 120 is conveyed, the speckle pattern on the web 120 is conveyed as well. When an identical speckle pattern is detected at different time points, the amount of movement of the speckle pattern is acquired. In other words, the calculator 53F acquires the amount of movement of the speckle pattern based on the detection of an identical speckle pattern, thereby acquiring the amount of travel of the web 120. Further, the calculator 53F converts the calculated amount of travel into an amount of travel per unit time, thereby acquire the speed at which the web 120 has moved. The amount of movement and speed of movement of the web 120 acquired are not limited to those in the conveyance direction 10. Since the imaging unit 16A outputs two-dimensional image data, the calculator 53F can calculate the amount or speed of two-dimensional movement.

Calculation

The calculator 53F performs cross-correlation operation of image data D1(*n*) acquired by the detecting unit 52A and image data D2(*n*) acquired by the detecting unit 52B. Hereinafter an image generated by the cross-correlation operation is referred to as "correlated image". For example, based on the correlated image data, the calculator 53F calculates the deviation amount ΔD(n), which is the amount of displacement from the position detected with the previous frame or by another sensor device.

For example, the cross-correlation operation is expressed by Formula 1 below.

$$D1*D2*=F-1[F[D1]\cdot F[D2]^*] \quad \text{Formula 1}$$

where D1 represents the first image data being the image taken by the position A, and Similarly, the image data D2(*n*) in Formula 1, that is, the data of the image taken at the position B, is referred to as the image data D2. In Formula 1, "F[ ]" represents Fourier transform, "F−1[ ]" represents inverse Fourier transform, "*" represents complex conjugate, and "*" represents cross-correlation operation.

As represented in Formula 1, image data representing the correlation image is acquired through cross-correlation operation "D1*D2" performed on the first image data D1 and the second image data D2. Note that, when the first image data D1 and the second image data D2 are two-dimensional image data, the correlated image data is two-dimensional image data. When the first image data D1 and the second image data D2 are one-dimensional image data, the image data representing the correlation image is one-dimensional image data.

Regarding the correlation image, when a broad luminance profile causes an inconvenience, phase only correlation can be used. For example, phase only correlation is expressed by Formula 2 below.

$$D1*D2*=F-1[P[F[D1]]\cdot P[F[D2]^*]] \quad \text{Formula 2}$$

In Formula 2, "P[ ]" represents taking only phase out of complex amplitude, and the amplitude is considered to be "1".

Thus, the calculator 53F can acquire the deviation amount ΔD(n) based on the correlation image even when the luminance profile is relatively broad.

The correlation image represents the correlation between the first image data D1 and the second image data D2. Specifically, as the match rate between the first image data D1 and the second image data D2 increases, a luminance causing a sharp peak (so-called correlation peak) is output at a position close to a center of the correlated image data. When the first image data D1 matches the second image data D2, the center of the correlation image and the peak position overlap.

Example of Correlation Operation

Figure 8:
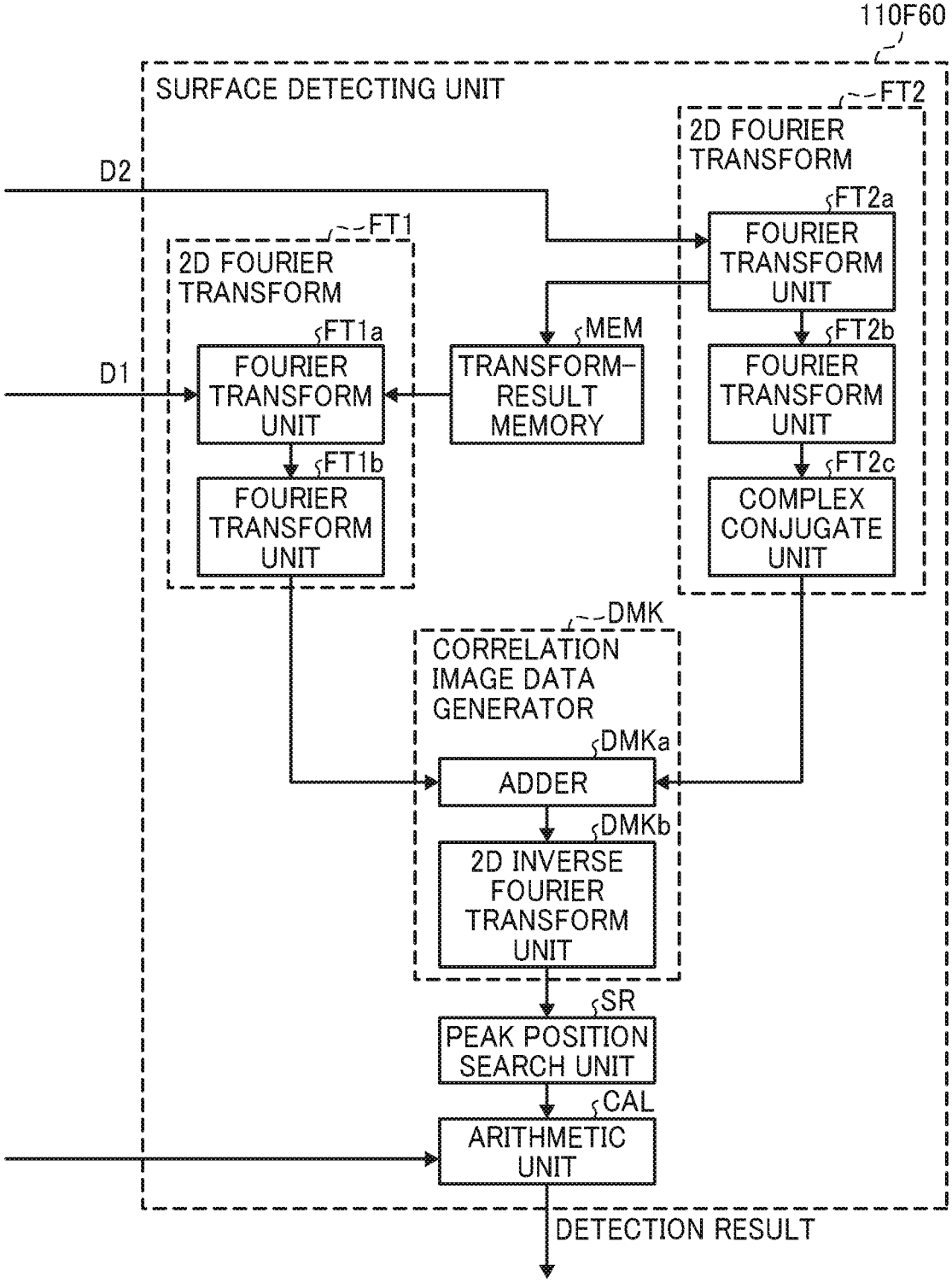
FIG. 8 is a diagram of a method of correlation operation according to an embodiment.

FIG. 8 is a diagram of a method of correlation operation according to the present embodiment. For example, with the illustrated configuration, the calculator 53F performs the correlation operation to output a detection result indicating at least one of a relative position of the web 120, acquiring the amount of travel of the web 120, and the speed thereof at the position of the imaging.

Specifically, the calculator 53F includes a 2D Fourier transform FT1 (a first 2D Fourier transform), a 2D Fourier transform FT2 (second 2D Fourier transform), a correlation image data generator DMK, a peak position search unit SR, an arithmetic unit CAL (or arithmetic logical unit), and a transform-result memory MEM.

The 2D Fourier transform FT1 is configured to transform the first image data D1. The 2D Fourier transform FT1 includes a Fourier transform unit FT1*a* for transform in the orthogonal direction 20 and a Fourier transform unit FT1*b* for transform in the conveyance direction 10.

The Fourier transform unit FT1*a* performs one-dimensional transform of the first image data D1 in the orthogonal direction 20. Based on the result of transform by the Fourier transform unit FT1*a* for orthogonal direction, the Fourier transform unit FT1*b* performs one-dimensional transform of the first image data D1 in the conveyance direction 10. Thus, the Fourier transform unit FT1*a* and the Fourier transform unit FT1*b* perform one-dimensional transform in the orthogonal direction 20 and the conveyance direction 10, respectively. The 2D Fourier transform FT1 outputs the result of transform to the correlation image data generator DMK.

Similarly, the 2D Fourier transform FT2 is configured to transform the second image data D2. The 2D Fourier transform FT2 includes a Fourier transform unit FT2*a* for transform in the orthogonal direction 20, a Fourier transform unit FT2*b* for transform in the conveyance direction 10, and a complex conjugate unit FT2*c*.

The Fourier transform unit FT2*a* performs one-dimensional transform of the second image data D2 in the orthogonal direction 20. Based on the result of transform by the Fourier transform unit FT2*a* for orthogonal direction, the Fourier transform unit FT2*b* performs one-dimensional transform of the second image data D2 in the conveyance direction 10. Thus, the Fourier transform unit FT2*a* and the Fourier transform unit FT2*b* perform one-dimensional transform in the orthogonal direction 20 and the conveyance direction 10, respectively.

Subsequently, the complex conjugate unit FT2*c* calculates a complex conjugate of the results of transform by the Fourier transform unit FT2*a* (for orthogonal direction) and the Fourier transform unit FT2*b* (for conveyance direction). Then, the 2D Fourier transform FT2 outputs, to the correlation image data generator DMK, the complex conjugate calculated by the complex conjugate unit FT2*c*.

The correlation image data generator DMK then generates the correlation image data, based on the transform result of the first image data D1, output from the 2D Fourier transform FT1, and the transform result of the second image data D2, output from the 2D Fourier transform FT2.

The correlation image data generator DMK includes an adder DMKa and a 2D inverse Fourier transform unit DMKb.

The adder DMKa adds the transform result of the first image data D1 to that of the second image data D2 and outputs the result of addition to the 2D inverse Fourier transform unit DMKb.

The 2D inverse Fourier transform unit DMKb performs 2D inverse Fourier transform of the result generated by the adder DMKa. Thus, the correlation image data is generated through 2D inverse Fourier transform. The 2D inverse Fourier transform unit DMKb outputs the correlation image data to the peak position search unit SR.

The peak position search unit SR searches the correlation image data for a peak position (a peak luminance or peak value), at which rising is sharpest. To the correlation image data, values indicating the intensity of light, that is, the degree of luminance, are input. The luminance values are input in matrix.

Note that, in the correlation image data, the luminance values are arranged at a pixel pitch of the sensor OS (i.e., an area sensor), that is, pixel size intervals. Accordingly, the peak position is preferably searched for after performing so-called sub-pixel processing. Sub-pixel processing enhances the accuracy in searching for the peak position. Then, the calculator 53F can output the position, the amount of movement, and the speed of movement.

An example of searching by the peak position search unit SR is described below.

Figure 9:
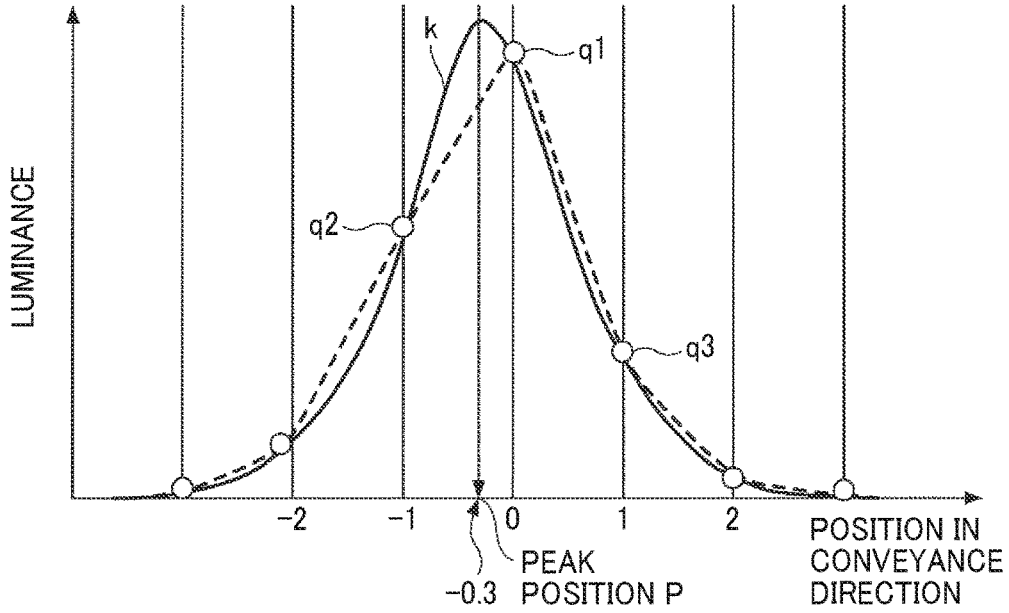
FIG. 9 is a graph for understanding of a peak position searched in the correlation operation.

FIG. 9 is a graph illustrating the peak position searched in the correlation operation according to the present embodiment. In this graph, the lateral axis represents the position in the conveyance direction 10 of an image represented by the correlation image data, and the vertical axis represents the luminance values of the image represented by the correlation image data.

The luminance values indicated by the correlation image data are described below using a first data value q1, a second data value q2, and a third data value q3. In this example, the peak position search unit SR searches for peak position P on a curved line k connecting the first, second, and third data values q1, q2, and q3.

Initially, the peak position search unit SR calculates each difference between the luminance values indicated by the correlation image data. Then, the peak position search unit SR extracts a largest difference combination, meaning a combination of luminance values between which the difference is largest among the calculated differences. Then, the peak position search unit SR extracts combinations of luminance values adjacent to the largest difference combination. Thus, the peak position search unit SR can extract three data values, such as the first, second, and third data values q1, q2, and q3 in the graph. The peak position search unit SR calculates the curved line K connecting these three data values, thereby acquiring the peak position P. In this manner, the peak position search unit SR can reduce the amount of operation such as sub-pixel processing to increase the speed of searching for the peak position P. The position of the combination of luminance values between which the difference is largest means the position at which rising is sharpest. The manner of sub-pixel processing is not limited to the description above.

Through the searching of the peak position P performed by the peak position search unit SR, for example, the following result is attained.

Figure 10:
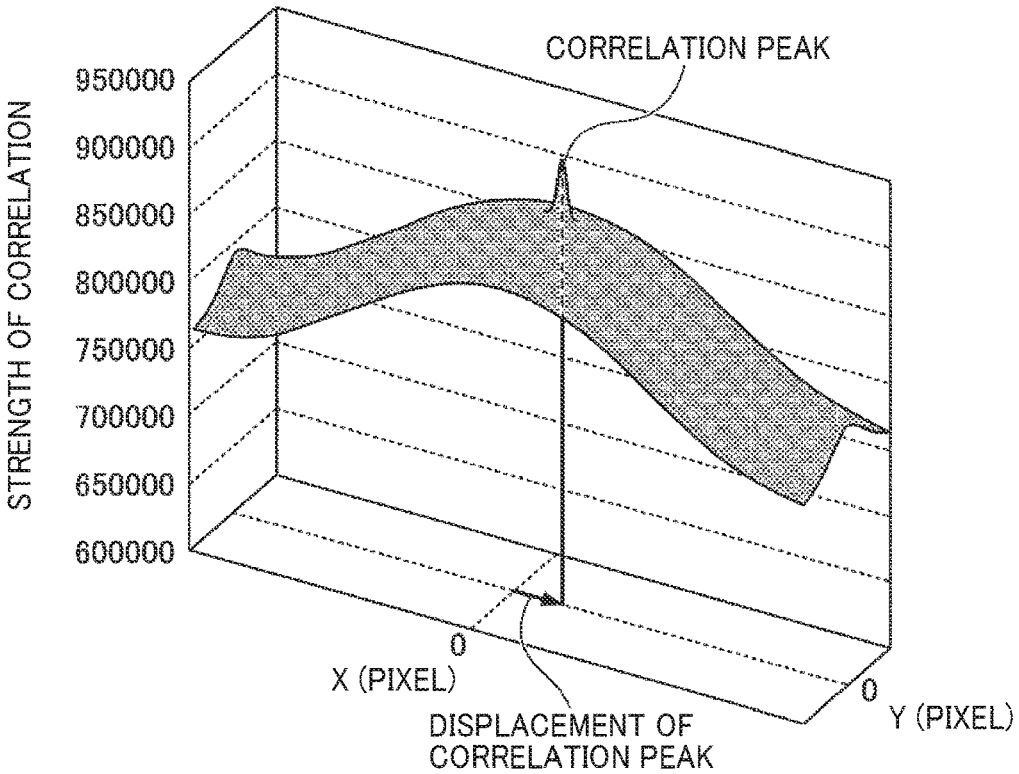
FIG. 10 is a diagram of example results of the correlation operation.

FIG. 10 is a diagram of example results of correlation operation and illustrates a profile of strength of correlation of a correlation function. In the drawing, X axis and Y axis represent serial number of pixel. The peak position search unit SR searches for a peak position such as "correlation peak" in the graph.

The arithmetic unit CAL calculates the relative position, amount of movement, or speed of movement of the web 120, or a combination thereof. For example, the arithmetic unit CAL calculates the difference between a center position of the correlation image data and the peak position calculated by the peak position search unit SR, to acquire the relative position and the amount of movement.

For example, the arithmetic unit CAL divides the amount of movement by time, to acquire the speed of movement.

Thus, the calculator 53F can calculate, through the correlation operation, the relative position, amount of movement, or speed of movement of the web 120. The methods of calculation of the relative position, the amount of movement, or the speed of movement are not limited to those described above. For example, alternatively, the calculator 53F acquires the relative position, amount of movement, or speed of movement through the following method.

Initially, the calculator 53F binarizes each luminance value of the first image data D1 and the second image data D2. That is, the calculator 53F binarizes a luminance value not greater than a predetermined threshold into "0" and a luminance value greater than the threshold into "1". Then, the calculator 53F may compare the binarized first and second image data D1 and D2 to acquire the relative position.

Although the description above concerns a case where fluctuations are present in Y direction, the peak position occurs at a position displaced in the X direction when there are fluctuations in the X direction.

Alternatively, the calculator 53F can adapt a different method to acquire the relative position, amount of movement, or speed of movement. For example, the calculator 53F can adapt so-called pattern matching processing to detect the relative position based on a pattern taken in the image data.

Control Configuration

The controller 520 illustrated in FIG. 2 is described below.

Figure 11:
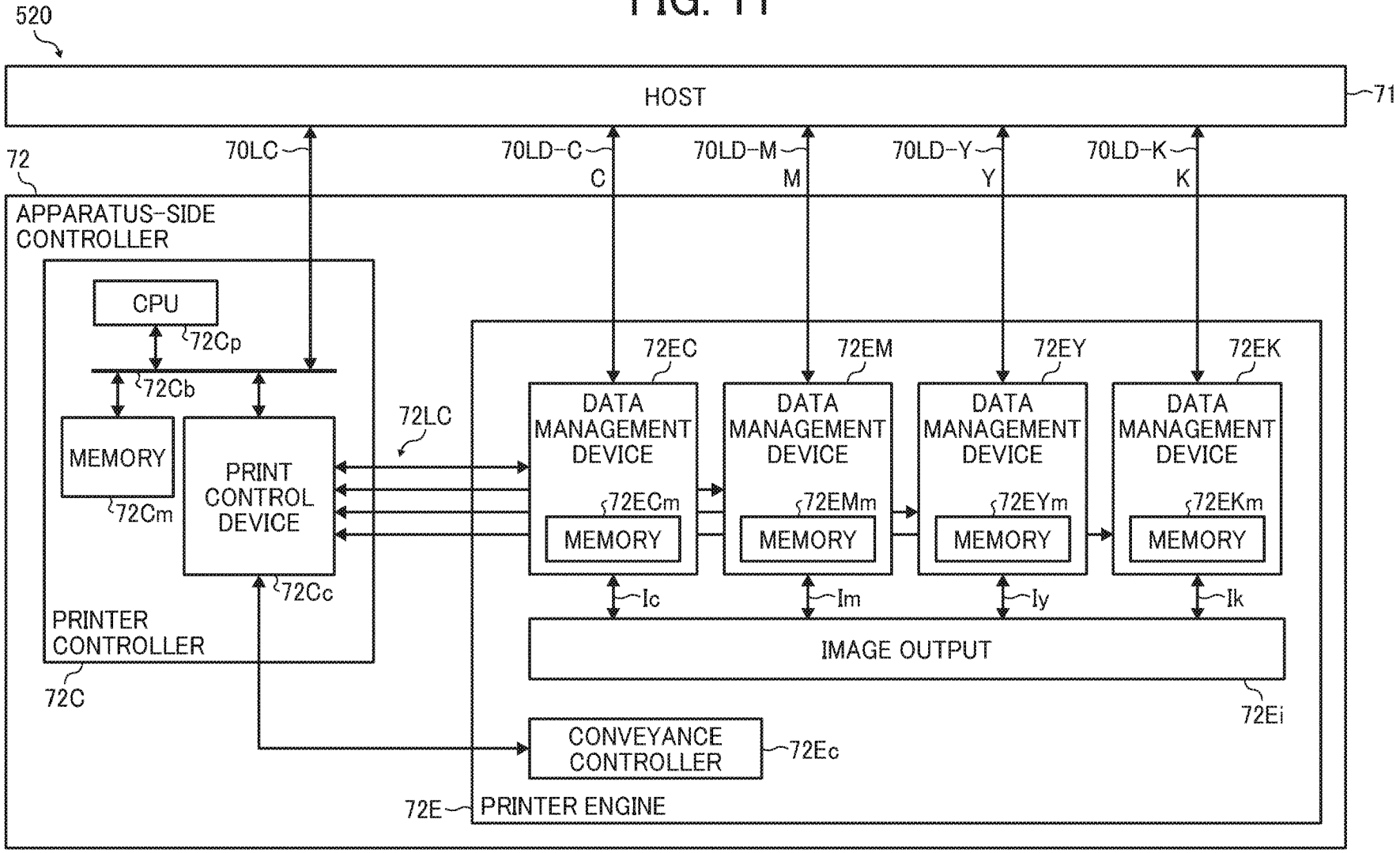
FIG. 11 is a schematic block diagram of a control hardware configuration according to an embodiment.

FIG. 11 is a schematic block diagram of control configuration according to the present embodiment. For example, the controller 520 includes a host 71 (or a higher-order device), such as an information processing apparatus, and an apparatus-side controller 72. In the illustrated example, the controller 520 causes the apparatus-side controller 72 to form an image on a recording medium according to image data and control data input from the host 71.

Examples of the host 71 include a client computer (personal computer or PC) and a server. The apparatus-side controller 72 includes a printer controller 72C and a printer engine 72E.

The printer controller 72C governs operation of the printer engine 72E. The printer controller 72C transmits and receives the control data to and from the host 71 via a control line 70LC. The printer controller 72C further transmits and receives the control data to and from the printer engine 72E via a control line 72LC. Through such data transmission and reception, the control data indicating printing conditions and the like are input to the printer controller 72C. The printer controller 72C stores the printing conditions, for example, in a resistor. The printer controller 72C then controls the printer engine 72E according to the control data to form an image based on print job data, that is, the control data.

The printer controller 72C includes a central processing unit (CPU) 72Cp, a print control device 72Cc, and a memory 72Cm. The CPU 72Cp and the print control device 72Cc are connected to each other via a bus 72Cb to communicate with each other. The bus 72Cb is connected to the control line 70LC via a communication interface (I/F) or the like.

The CPU 72Cp controls the entire apparatus-side controller 72 based on a control program and the like. That is, the CPU 72Cp is a processor as well as a controller.

The print control device 72Cc transmits and receives data indicating a command or status to and from the printer engine 72E, based on the control date transmitted from the host 71. Thus, the print control device 72Cc controls the printer engine 72E.

To the printer engine 72E, a plurality of data lines, namely, data lines TOLD-C, TOLD-M, TOLD-Y, and TOLD-K are connected. The printer engine 72E receives the image data from the host 71 via the plurality of data lines. Then, the printer engine 72E performs image formation of respective colors, controlled by the printer controller 72C.

The printer engine 72E includes a plurality of data management devices, namely, data management devices 72EC, 72EM, 72EY, and 72EK respectively including memory 72ECm, 72EMm, 72EYm, and 72EKm. The printer engine 72E includes an image output 72Ei and a conveyance controller 72Ec.

Figure 12:
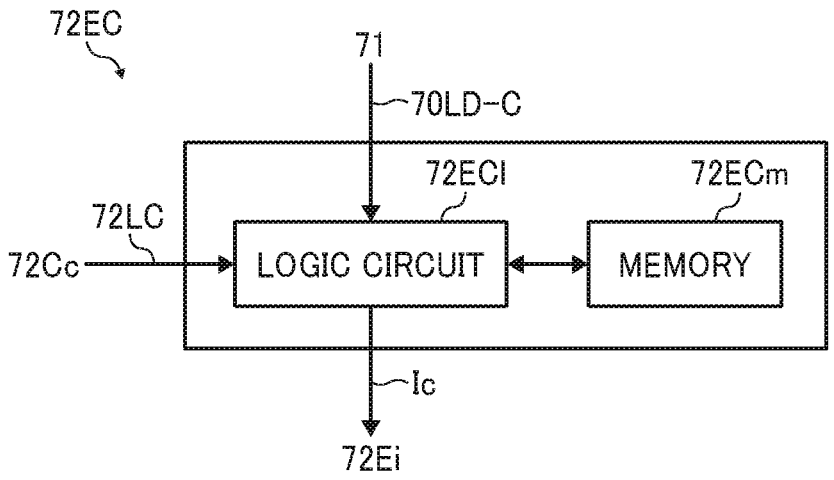
FIG. 12 is a block diagram of a hardware configuration of a data management device of the configuration illustrated in FIG. 11.

FIG. 12 is a block diagram of a configuration of the data management device 72EC. For example, the plurality of data management devices 72EC, 72EM, 72EY, and 72EK can have an identical configuration, and the data management device 72EC is described below as a representative. Redundant descriptions are omitted.

The data management device 72EC includes a logic circuit 72EC1 and a memory 72ECm. As illustrated in FIG. 12, the logic circuit 72EC1 is connected via a data line 7OLD-C to the host 71. The logic circuit 72EC1 is connected via the control line 72LC to the print control device 72Cc. The logic circuit 72EC1 is implemented by, for example, an application specific integrated circuit (ASIC) or a programmable logic device (PLD).

According to a control signal input from the printer controller 72C (illustrated in FIG. 11), the logic circuit 72EC1 stores, in the memory 72ECm, the image data input from the host 71.

According to a control signal input from the printer controller 72C, the logic circuit 72EC1 retrieves, from the memory 72ECm, cyan image data Ic. The logic circuit 72EC1 then transmits the cyan image data Ic to the image output 72Ei. Similarly, magenta image data Im, yellow image data Iy, and black image data Ik are transmitted to the image output 72Ei.

The memory 72ECm preferably has a capacity to store image data extending about three pages. With the capacity to store image data extending about three pages, the memory 72ECm can store the image data input from the host 71, data image being used current image formation, and image data for subsequent image formation.

Figure 13:
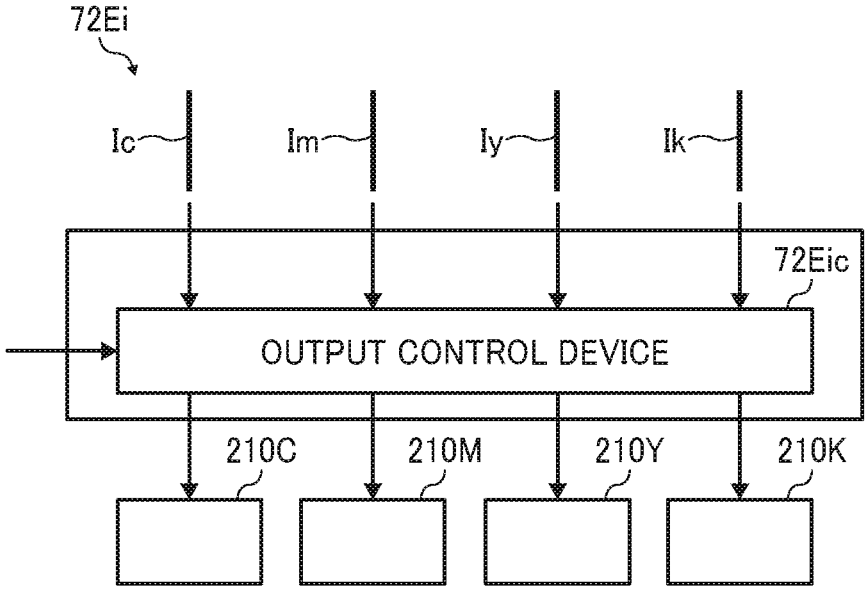
FIG. 13 is a block diagram of a hardware configuration of an image output device of the configuration illustrated in FIG. 11.

FIG. 13 is a block diagram of a configuration of the image output 72Ei. In this block diagram, the image output 72Ei is constructed of an output control device 72Eic and the liquid discharge head units 210K, 210C, 210M, and 210Y.

The output control device 72Eic outputs the image data for respective colors to the liquid discharge head units 210. That is, the output control device 72Eic controls the liquid discharge head units 210 based on the image data input thereto.

The output control device 72Eic controls the plurality of liquid discharge head units 210 either simultaneously or individually. That is, the output control device 72Eic receives timing commands and changes the timings at which the liquid discharge head units 210 discharge respective color inks. The output control device 72Eic can control one or more of the liquid discharge head units 210 based on the control signal input from the printer controller 72C. Alternatively, the output control device 72Eic can control one or more of the liquid discharge head units 210 based on user instructions.

In this example, the apparatus-side controller 72 has different routes for inputting the image data from the host 71 and for transmission and reception of control data, with the host 71 and the apparatus-side controller 72.

The apparatus-side controller 72 may instruct formation of single-color images using one color ink, for example, black ink. In the case of single-color image formation using black ink, to accelerate image formation speed, the liquid discharge apparatus 110 can include one data management device (the data management devices 72EC, 72EM, 72EY, or 72EK) and four black liquid discharge head units 210. In such as configuration, the plurality of black liquid discharge head units 210K discharge black ink. Accordingly, the image formation speed is faster than that in the configuration using one black liquid discharge head unit 210K.

The conveyance controller 72Ec includes a motor and the like for conveyance of the web 120. For example, the conveyance controller 72Ec controls the motor coupled to the rollers to convey the web 120.

Example of flow of adjustment of data acquisition timing

Figure 14A:
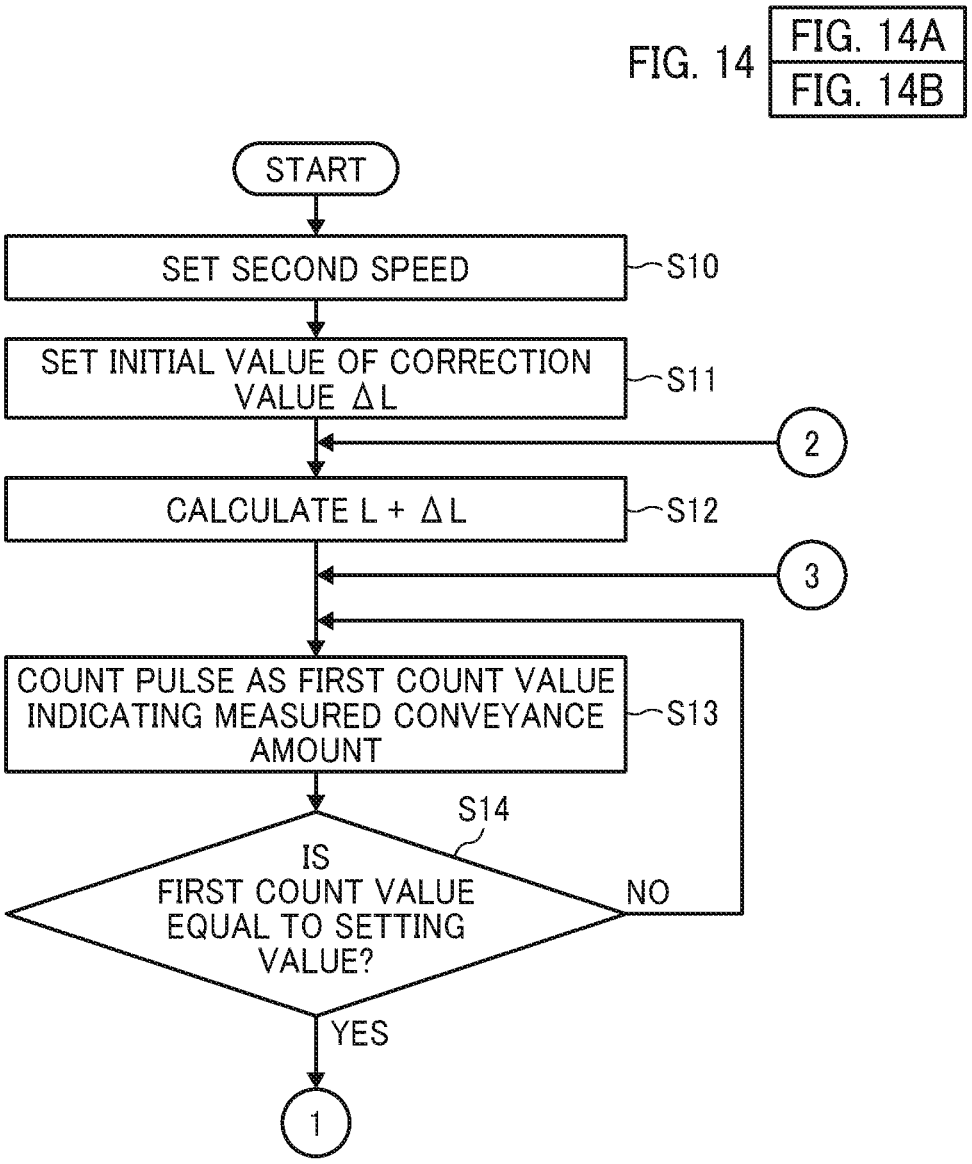
FIGS. 14A and 14B are flowcharts of processing performed by a liquid discharge apparatus according to an embodiment.
Figure 14B:
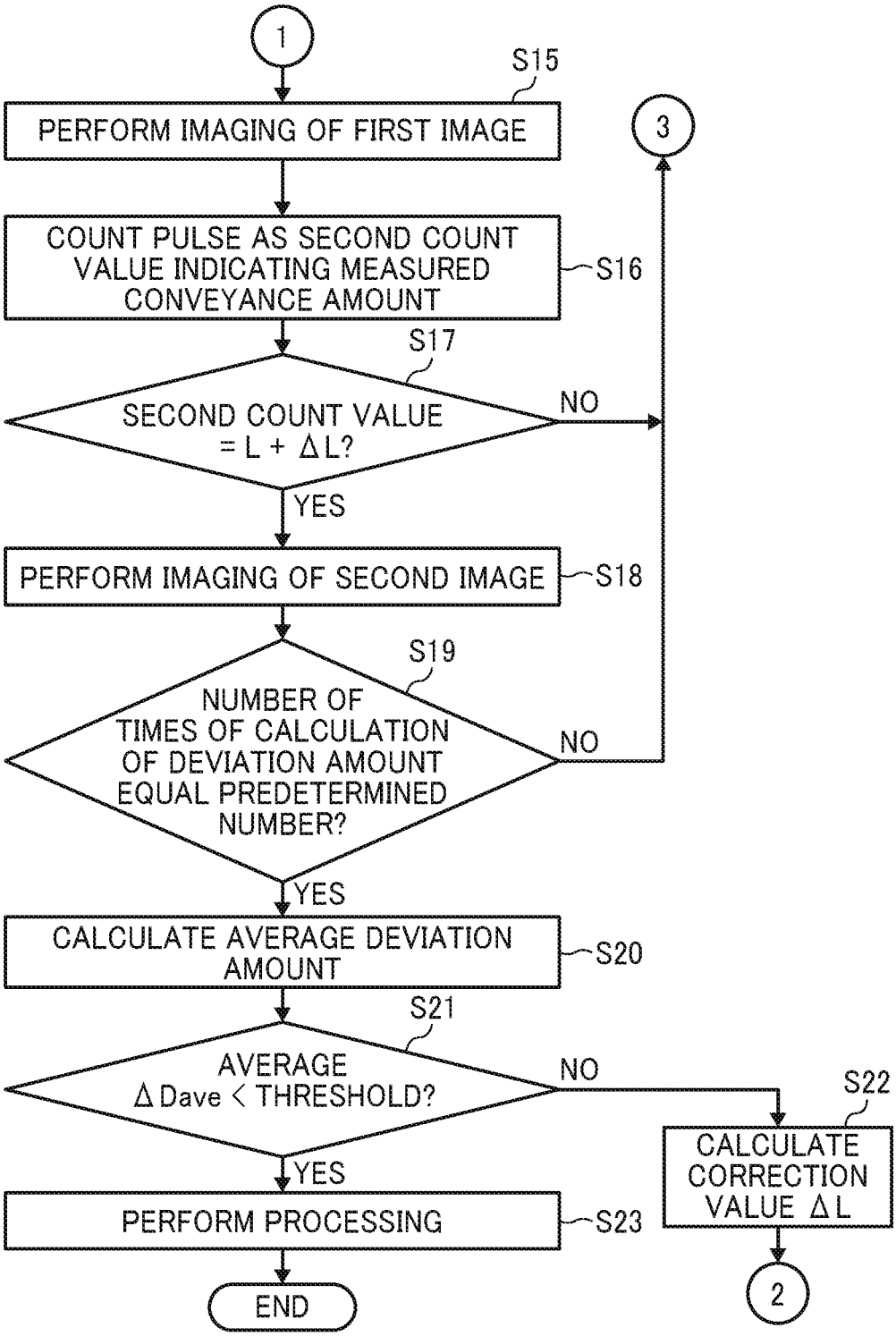

FIGS. 14A and 14B is a flowchart of adjustment of timing of acquisition of data (e.g., imaging) for calculating detection result according to the present embodiment.

In the example described below, when an image is to be formed, the liquid discharge apparatus 110 conveys the conveyed object at a first conveyance speed in the conveyance direction 10. By contrast, for adjusting the timing of acquisition of data used to calculate the detection result, preferably, the liquid discharge apparatus 110 conveys the conveyed object at a predetermined speed for adjustment (i.e., a second speed) in the conveyance direction 10.

At S10, the liquid discharge apparatus 110 sets the second conveyance speed. The liquid discharge apparatus 110 adjusts the timing of detection, for example, in preparation before image formation. The second conveyance speed is preferably lower than the first conveyance speed. The first conveyance speed is a relatively high speed and, for example, equal to or higher than 1000 mm/s. The second conveyance speed is a relatively low speed and, for example, 10 mm/s. Conveying the web 120 at such as low speed can suppress disturbance such as slip of the web 120.

At S11, the adjusting unit 110F40 sets an initial value of a correction value ΔL. For example, the initial value is zero (0). Alternatively, a user or an operator can preliminarily set the initial value.

At S12, the adjusting unit 110F40 calculates a sum of the distance L between the sensors OS (also referred to as "sensor interval") and the correction value ΔL.

Since the correction value ΔL is set at zero (ΔL=0) in the initial state at S11, the sum of the relative distance L and the correction value ΔL is expressed as L+ΔL=L). That is, the initial state is an ideal state in which the relative distance L is not corrected with the correction value ΔL. Accordingly, in the ideal state, time required for conveying the conveyed object by the distance L between the sensors OS is acquired by dividing the distance L by the conveyance speed.

At S13, the measurement unit 110F20 counts the pulses indicating the conveyance amount of the web 120 being conveyed at the second speed, output from the encoder ENC, to measure the conveyance amount of the web 120. Hereinafter, the amount of travel of the conveyed object calculated by the calculator 53F is referred to as "a calculated travel amount. By contrast, the amount of travel of the conveyed object measured with the gauge such as the encoder ENC is referred to as "measured conveyance amount" or "measured travel amount".

At S13, the measurement unit 110F20 counts the pulses ENP with respect to a home position of the encoder ENC, to determined whether the timing to start imaging by the sensor OS has arrived. The encoder pulse ENP is an example count of measured conveyance amount. The encoder ENC outputs the encoder pulse ENP each time the rotary plate rotates by a predetermined angle, in response to the amount of rotation of the roller 230 equivalent to the amount by which the conveyed object is conveyed. Accordingly, the liquid discharge apparatus 110 can multiply the interval of output of the encoder pulses ENP with the count value to acquire the measured conveyance amount, based on which the timing to start imaging is determined. The count value acquired at S13 is referred to as "first count".

At S14, the adjusting unit 110F40 determines whether or not the first count value is equal to a setting value corresponding to the timing at which the sensor OS starts imaging. For example, a plurality of values selected from 0 to 360 degrees with respect to a home position of the encoder ENC is used as the setting values, so that variations in rotation period of the roller 230 can be cancelled. Cancel of variations in rotation period is described later.

When the adjusting unit 110F40 determines that the first count value is equal to the setting value (Yes at S14), the process proceeds to S15. When the adjusting unit 110F40 determines that the first count value is not equal to the setting value (No at S14), the process returns to S13.

At S15, the imaging unit 16A performs imaging of a first image, that is, acquires image data on the upstream side (the position A) in the functional configuration illustrated in FIG. 7.

At S16, the measurement unit 110F20 counts the encoder pulse ENP. The encoder pulse ENP is an example count representing the measured conveyance amount (measured travel amount) as described above. The measured conveyance amount measured at S16 is a value starting from the position where a first one of the sensors performs the detection. Specifically, in the arrangement illustrated in FIG. 2, the second count value is the value of count starting at the position of detection by the sensor device SENK. The liquid discharge apparatus 110 measures the relative distance L between the sensor devices SENK and SENC with the count of the encoder pulse ENP. The relative distance L is considered as a reference value of the distance between the sensors.

Counting of the first and second count values can be made by either an identical counter or different counters. For example, a different counter can be used for each distance between the sensors. For example, in the example illustrated in FIG. 2, the counting from the sensor device SENK to the sensor device SENC and that from the sensor device SENK to the sensor device SENM can be performed by different counters. Additionally, the distance between the sensors OS in which the counting is performed is not limited to the distance between the sensor devices SENK and SENC but can be the distance from the sensor device SENC to the sensor device SENM.

At S17, the adjusting unit 110F40 determines whether or not the second count value of the measured conveyance amount is equal to the value L+ΔL, that is, whether the second count value of the encoder pulse ENP reaches the value equivalent to the distance between the upstream sensor device SEN and the downstream sensor device SEN (L+ΔL).

When the adjusting unit 110F40 determines that the measured conveyance amount is equal to the value expressed as L+ΔL (Yes at S17), the process proceeds to S18. When the adjusting unit 110F40 determines that the measured conveyance amount is not equal to the value expressed as L+ΔL (No at S17), the process returns to S16.

At S18, the imaging unit 16B performs imaging of a second image, that is, acquires image data on the downstream side (the position B) in the functional configuration illustrated in FIG. 7.

Note that, preferably, the liquid discharge apparatus 110 repasts the process from S13 to S19 to calculate a plurality of deviation amounts based on counting started at a plurality of rotation positions and calculate an average ΔDave through statistical processing of the plurality of deviation amounts. As described above, a plurality of rotation positions is stored as the setting values. From the imaging of the first image performed at different rotation positions, the deviation amounts starting at different rotations angles, respectively, can be acquired. When the average ΔDave is calculated through statistical processing of the plurality of deviation amounts, the variations in rotation period of the roller 230 can be cancelled.

Initially, with the image data on the upstream side and the image data on the downstream side, the liquid discharge apparatus 110 can detect the actual position of the web 120 by the image captured by the sensor OS when the web 120 has traveled by the distance L+ΔL, based on the above-described result of correlation operation by the calculator 53F. Then, the deviation calculator 110F50 can detect the amount by which the sensor interval has deviated from the distance L+ΔL, that is, can detect the actual sensor interval. For example, from the first image data and the second image data acquired at S15 and S18, the liquid discharge apparatus 110 can detect the deviation in the distance between the sensor devices SENK and SENC. Thus, the liquid discharge apparatus 110 can acquire the value representing the deviation from the sensor interval (hereinafter also simply "sensor interval deviation") based on the detection result of the sensor OS.

Accordingly, from a plurality of measured conveyance amounts and a plurality of image data, the deviation calculator 110F50 can calculate a plurality of deviation amounts. The number of times the deviation amount is calculated is predetermined by a user or the like (i.e., the number of deviation amounts calculated).

At S19, the deviation calculator 110F50 determines whether the number of times of calculation of deviation is equal to the predetermined number of times. The deviation calculator 110F50 repeats the steps from S13 to S19 until the predetermined number of deviation amounts are acquired.

When the deviation calculator 110F50 determines that the number of times of calculation of deviation is equal to the predetermined number (Yes at S19), the process proceeds to S20. When the deviation calculator 110F50 determines that the number of times of calculation of deviation is not equal to the predetermined number (No at S19), the process returns to S16.

At S20, the deviation calculator 110F50 calculates the average ΔDave of the deviation amounts. That is, at S20, the deviation calculator 110F50 performs statistical processing of the plurality of deviation amounts to calculate a statistic. For example, the statistic is the average or moving average. In the description below, the statistic is the average ΔDave.

At S21, the adjusting unit 110F40 determines whether the average ΔDave is smaller than a threshold. The threshold represents the limit of tolerable range of deviation based on specifications. The threshold is predetermined by the user or the like. Thus, the adjusting unit 110F40 determines whether the average ΔDave is in the tolerable range.

When the adjusting unit 110F40 determines that the average ΔDave is smaller than the threshold (Yes at S21), the process proceeds to S23. By contrast, when the adjusting unit 110F40 determines that the average ΔDave is equal to or greater than the threshold (No at S21), the process proceeds to S22.

At S22, the adjusting unit 110F40 calculates the correction value ΔL. The correction value ΔL thus calculated is reflected at S12. In this manner, the liquid discharge apparatus 110 can adjusts the timing of acquisition of data by each sensor device SEN. The details of the adjustment are described later.

At S23, the liquid discharge apparatus 110 causes the head unit to perform image formation (the operation by the head unit) while conveying the conveyed object at the first conveyance speed. During the image formation, the calculator 53F calculates the detection result such as the position of the web 120, based on the data acquired by the sensor at the acquisition timing corrected with the correction value ΔL. Further, based on the detection result thus acquired, the liquid discharge apparatus 110 performs adjustment of the timing of operation (e.g., liquid discharge timing), position adjustment of the head unit in the orthogonal direction 20, or both.

Although the data acquisition timing is adjusted before image formation (S23) in the description above, alternatively, the adjustment can be performed in an interval between jobs.

Example adjustment of data acquisition timing

Figure 15:
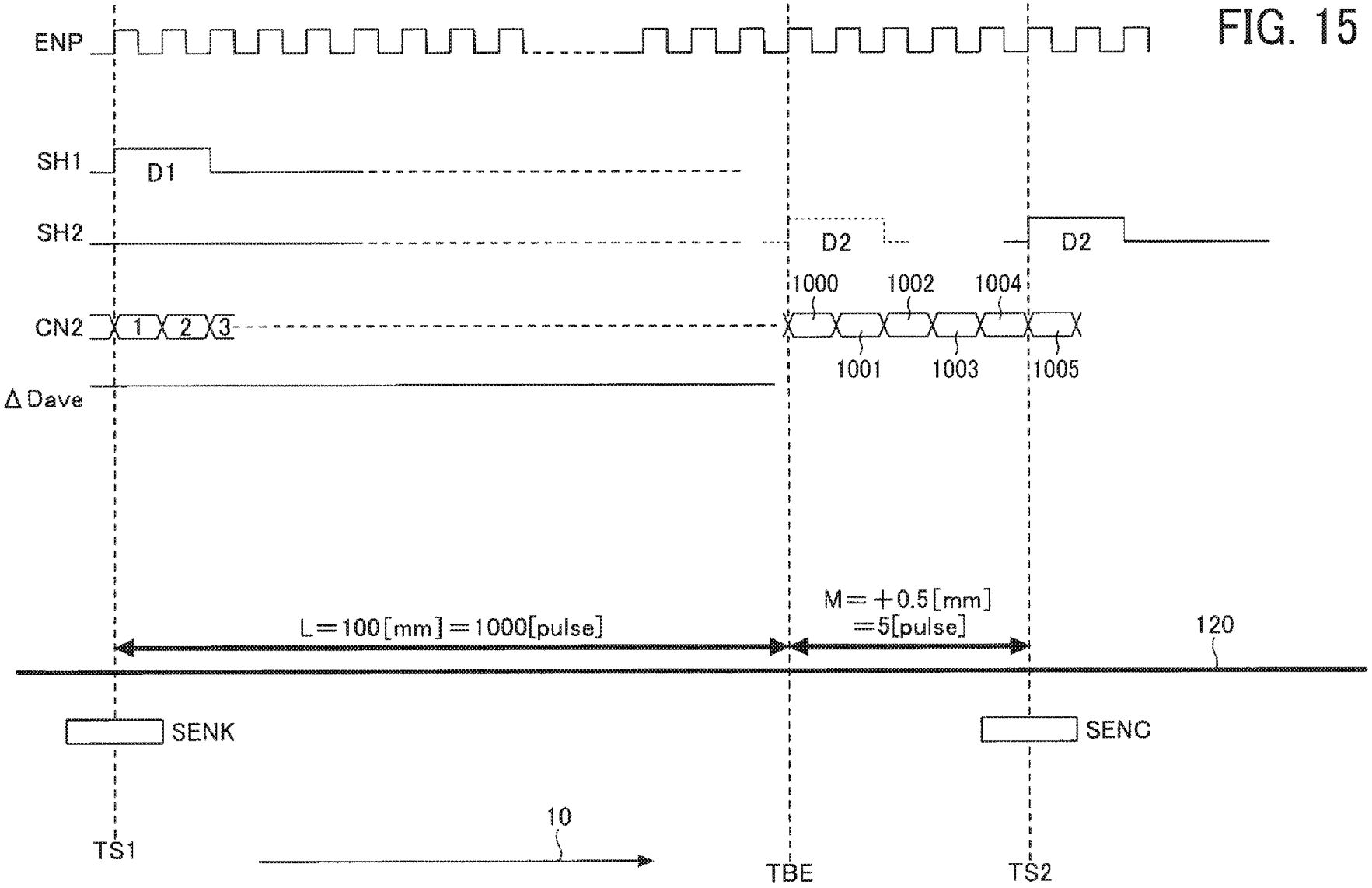
FIG. 15 is a timing chart of adjustment according to an embodiment.

FIG. 15 is a timing chart of adjustment according to the present embodiment. Through the process illustrated in FIGS. 14A and 14B, the adjusting unit 110F40 can adjust the timing, for example, as illustrated in FIG. 15.

Descriptions below are based on a combination of the sensor device SENK for black (i.e., upstream sensor) and the sensor device SENC for cyan (i.e., downstream sensor). In this example, the respective sensors OS of the sensor devices SENK and SENC is at a distance 100 mm (the relative distance L) from each other. However, this example is on the assumption that the position where the sensor OS is mounted has an error (hereinafter "attachment position error M). In this example, the attachment position error M is +0.5 mm. In other words, as illustrated, the sensor device SENC is disposed at +0.5 mm shifted from the distance L from the sensor device SENK. Note that the descriptions below are on an assumption that there is no disturbance other than the attachment position error M.

In this example, one pulse of the encoder pulse ENP is 0.1 mm. An encoder counter CN2 counts the encoder pulse ENP.

In the drawing, an acquisition timing signal SH1 is for controlling the timing of imaging by the sensor device SENK for black. Specifically, at first acquisition timing TS1 at which the acquisition timing signal SH1 is asserted (turned on), the sensor device SENK releases the shutter to generate the first image data D1.

Similarly, an acquisition timing signal SH2 is for controlling the timing of imaging by the sensor device SENC for cyan. Specifically, at second acquisition timing TS2 at which the acquisition timing signal SH2 is asserted (turned on), the sensor device SENC releases the shutter to generate the second image data D2. In this example, the adjusting unit 110F40 adjusts the time from when the acquisition timing signal SH1 is asserted to when the acquisition timing signal SH2 is asserted (turned on). Accordingly, in this example, at the first acquisition timing TS1 at which the acquisition timing signal SH1 is asserted, the encoder counter CN2 is reset and simultaneously starts counting as illustrated.

In the process illustrated in FIGS. 14A and 14B, the initial value corresponding to the state without the attachment position error M is set at S11. With this setting, since the correction value ΔL is 0, when the measured conveyance amount reaches the distance L, that is, the encoder counter CN2 counts "1000" (Yes at S17), the sensor device SENC releases the shutter to generate the second image data D2 (S18), which is unadjusted timing TBE.

Even when the second image data D2 is generated at the unadjusted timing TBE, the possibility of slip or the like is small as long as the web 120 is conveyed at a low speed such as the second conveyance speed. Accordingly, it is highly possible that the second image data D2 includes the portion of the web 120 (i.e., web portion) taken in the first image data D1. Therefore, for example, the liquid discharge apparatus 110 compares the position of the web portion indicated in the second image data D2 with the center coordinates or the like of the second image data D2, to calculate the deviation amount ΔD. As the deviation amount ΔD is repeatedly calculated for the predetermined number of times, the deviation calculator 110F50 can calculate the average ΔDave of the deviation amounts ΔD (S20). It is assumed that the average ΔDave is −0.5 mm.

In the illustrated example, since the average ΔDave is −0.5 mm, the acquisition timing for the sensor device SENC is adjusted to be delayed by 5 pulses from the unadjusted timing TBE.

Accordingly, in this example, the correction value LΔ is calculated as +0.5 mm to cancel the average ΔDave (S22). With the correction value LΔ thus set (S12), the acquisition timing for the sensor device SENC is adjusted by the correction value ΔL from the unadjusted timing TBE to the second acquisition timing TS2. That is, the adjusting unit 110F40 sets the adjusted acquisition timing for the sensor device SENC as L+ΔL=1000+5=1005 pulses.

Such adjustment can attain the following effects.

Figure 16:
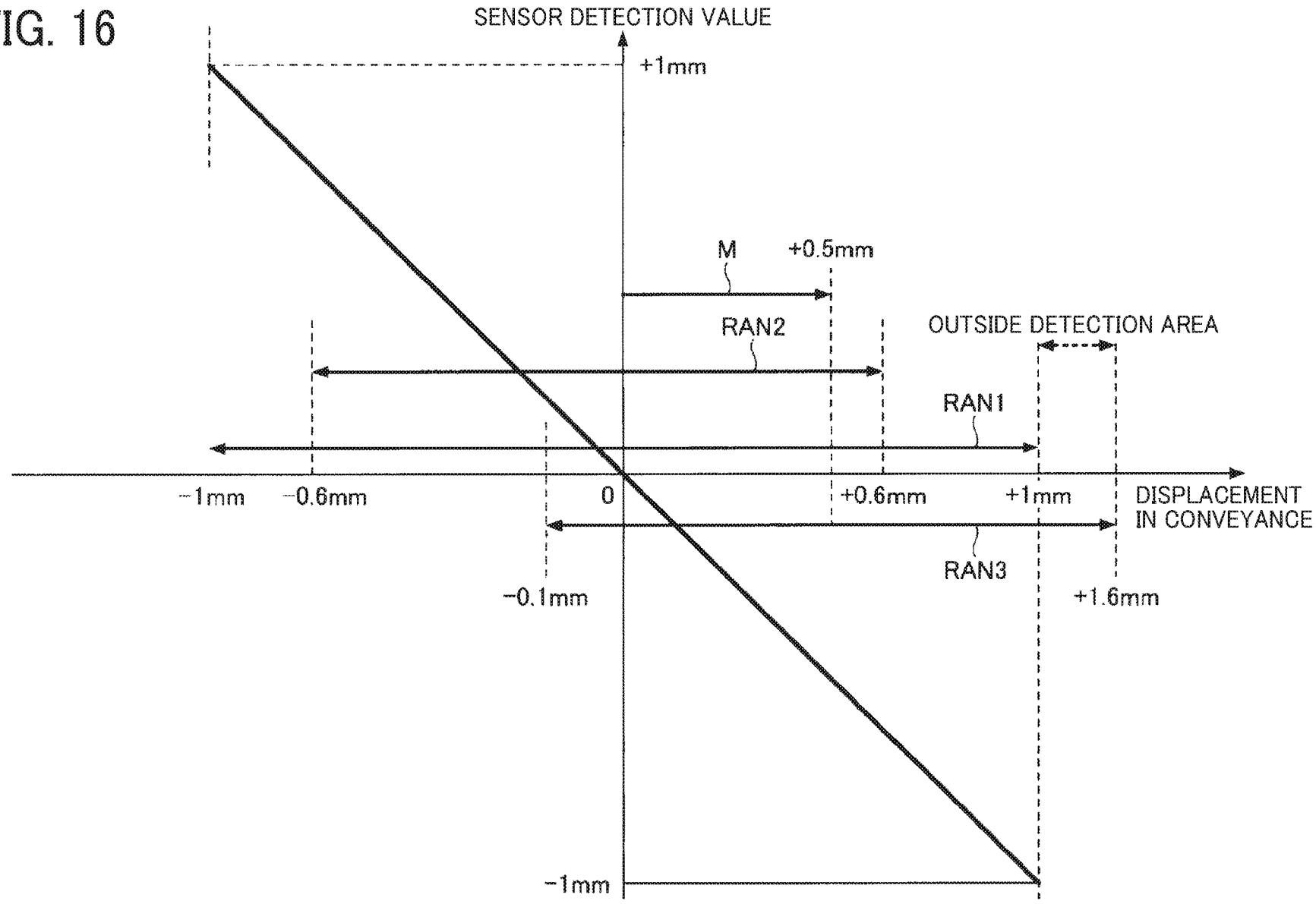
FIG. 16 illustrates an example effect attained by adjustment illustrated in FIGS. 14A and 14B.

FIG. 16 illustrates example effects attained by the adjustment according to the present embodiment. The sensor OS has, for example, 256 pixels (1 pixel is 8 μm) in the conveyance direction 10. With this specification, the sensor OS can detect, e.g., the position of the conveyed object, in a detection area of about 2 mm. In other words, the area in which the sensor OS can detect the position is about ±1 mm from the origin.

The description below is based on the specification where the detection area of the sensor OS is about ±1 mm from the origin. Specifically, the sensor OS can detect the position of the conveyed object in a detection area RAN1 centering on the origin "0" in FIG. 16.

Further, the description below is on the assumption that the conveyance of the conveyed object includes displacement within ±0.6 mm. In FIG. 16, the position of the conveyed object fluctuates in a fluctuation range RAN2 centering on the origin "0" due to slip or the like. Since the detection area RAN1 of the sensor OS extends ±1 mm from the origin as illustrated, the sensor OS can detect the position of the conveyed object, which displaces within the fluctuation range RAN2, when the attachment position error M is not present. In FIG. 16, fluctuations in position of the conveyed object appear on the vertical axis representing the value detected by the sensor OS (i.e., sensor detection value).

By contrast, in a case where the position of the sensor OS has the attachment error of +0.5 mm similar to the example illustrated in FIG. 15. Due to the attachment position error M, the position of the conveyed object fluctuates centering on the position "+0.5 mm" in FIG. 16. Accordingly, in the presence of the attachment position error M, the position of the conveyed object fluctuates in a fluctuation range RAN3 extending from −0.1 mm to +1.6 mm. In the case of the fluctuation range RAN3, the position of the conveyed object can be displaced outside the detection area RAN1. Specifically, the sensor having the illustrated specification fails to detect the fluctuations in a range of +1.0 mm to 1.6 mm, exceeding +1.0 mm, of the fluctuations in the fluctuation range RAN3.

Therefore, owing to the adjustment illustrated in FIG. 15, the liquid discharge apparatus 110 can cancel the attachment position error M. In other words, in the example illustrated in FIG. 16, as the adjustment is performed, the effect of the attachment position error M is reduced, and the liquid discharge apparatus 110 can detect fluctuations of the conveyed object as in the fluctuation range RAN2.

With this configuration, the liquid discharge apparatus 110 can adjust, with the adjusting unit 110F40, the timing of acquisition of data used to calculation of the detection result by the calculator 53F illustrated in FIG. 7.

For example, the attachment position error M is likely to occur when the sensors OS to implement the detecting units 52A and 52B are newly installed or the location of the sensor OS is changed. The attachment position error M probably makes the sensor interval deviate from the reference value of the relative distance L.

Therefore, before performing image formation (at S23 in FIGS. 14A and 14B), the liquid discharge apparatus 110 adjusts the acquisition timing, for example, with the process illustrated in FIGS. 14A and 14B. Specifically, as illustrated in FIG. 15, the measurement unit 110F20 illustrated in FIG. 7 measures the measured conveyance amount (measured travel amount) with the encoder counter CN2. When the measured conveyance amount reaches the predetermined value, at the unadjusted timing TBE illustrated in FIG. 15, the detecting unit 52B on the downstream side in FIG. 7 generates the second image data D2. Subsequently, the liquid discharge apparatus 110 can calculate the deviation amount ΔD based on the detection result such as the second image data D2, output at the unadjusted timing TBE.

Calculation During Operation Such as Image Formation

As illustrated in FIG. 7, the imaging unit 16A and the imaging unit 16B are disposed at the predetermined interval from each other in the conveyance direction 10. The imaging unit 16A and the imaging unit 16B perform imaging of the web 120 at the respective positions. In this period, the web 120 travels at the first conveyance speed.

As described above, the interval between the imaging by the imaging unit 16A and that by the imaging unit 16B is adjusted to the value expressed as L+ΔL. In the example described below, the imaging units 16A and 16B correspond to the upstream sensor and the downstream sensor, respectively. The adjusting unit 110F40 outputs instruction for imaging to the shutter controller 141A. Further, based on the data output from the measurement unit 110F20, the adjusting unit 110F40 outputs instruction for imaging to the shutter controller 141B to at timing equivalent to L+ΔL from when the instruction for imaging is output to the shutter controller 141A. Then, the imaging units 16A and 16B perform imaging at the interval represented by L+ΔL and output image data including the speckle pattern. The calculator 53F performs a correlation operation using this image data.

Based on the correlation operation, the calculator 53F outputs the displacement in position, the amount of movement, or the speed of movement between the first image data D1 and the second image data D2 acquired at the time difference equivalent to L+ΔL. For example, the result of correlation is the amount by which the web 120 has moved in the orthogonal direction 20 from the position of the first image data D1 to the position of the second image data D2. Alternatively, the result of correlation operation can be the speed of movement instead of the amount of movement. Thus, based on the result of the correlation operation, the calculator 53F can calculate the amount by which the head moving unit 110F80 moves the liquid discharge head unit 210C for cyan in the orthogonal direction 20, during image formation. Details are to be described later.

Further, based on the result of correlation operation, the calculator 53F can calculate the amount by which the conveyance amount of the web 120 in the conveyance direction 10 is deviated. Based on this result, the control unit 110F30 can change the timing of liquid discharge from the liquid discharge head unit 210. The change of timing of operation such as discharge of liquid (or image formation) will be described later in detail.

Sharing the sensor device in detecting positions in both directions can reduce the cost of the apparatus. Additionally, the space for the detection can be small since the number of sensors is reduced.

Change of Timing of Operation

Figure 17:
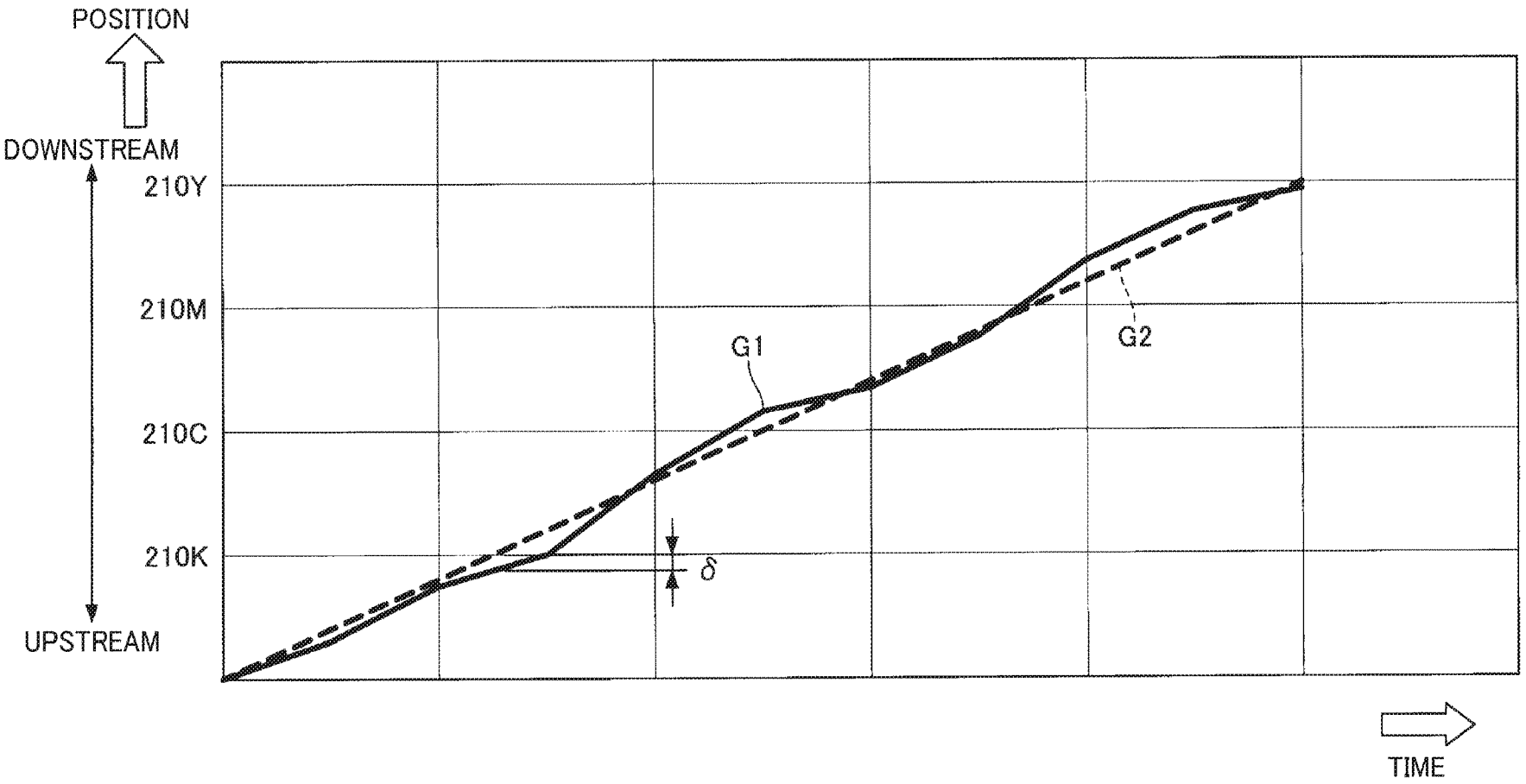
FIG. 17 is a graph illustrating an example of deviations in ink landing position.

FIG. 17 is a graph illustrating an example of deviations in ink landing position when the ink lands in a state without adjustment.

A first graph G1 represents an actual position of the web 120. A second graph G2 represents a position of the web 120 calculated based on the encoder pulse ENP from the encoder ENC. That is, when the second graph G2 differs from the first graph G1, the actual position of the web 120 and the calculated position thereof differs in the conveyance direction 10, and the landing position is likely to deviate.

In this example, a deviation amount δ occurs in discharge of liquid from the liquid discharge head unit 210K. The amount of deviation may differ among the liquid discharge head units 210. That is, the amount of deviation in discharge of liquid other than black ink is probably different from the deviation amount δ.

The deviation is derived from, for example, an eccentricity of the roller, thermal expansion of the roller, slip between the web 120 and the roller, expansion and shrink of the web 120, and a combination thereof.

Figure 18:
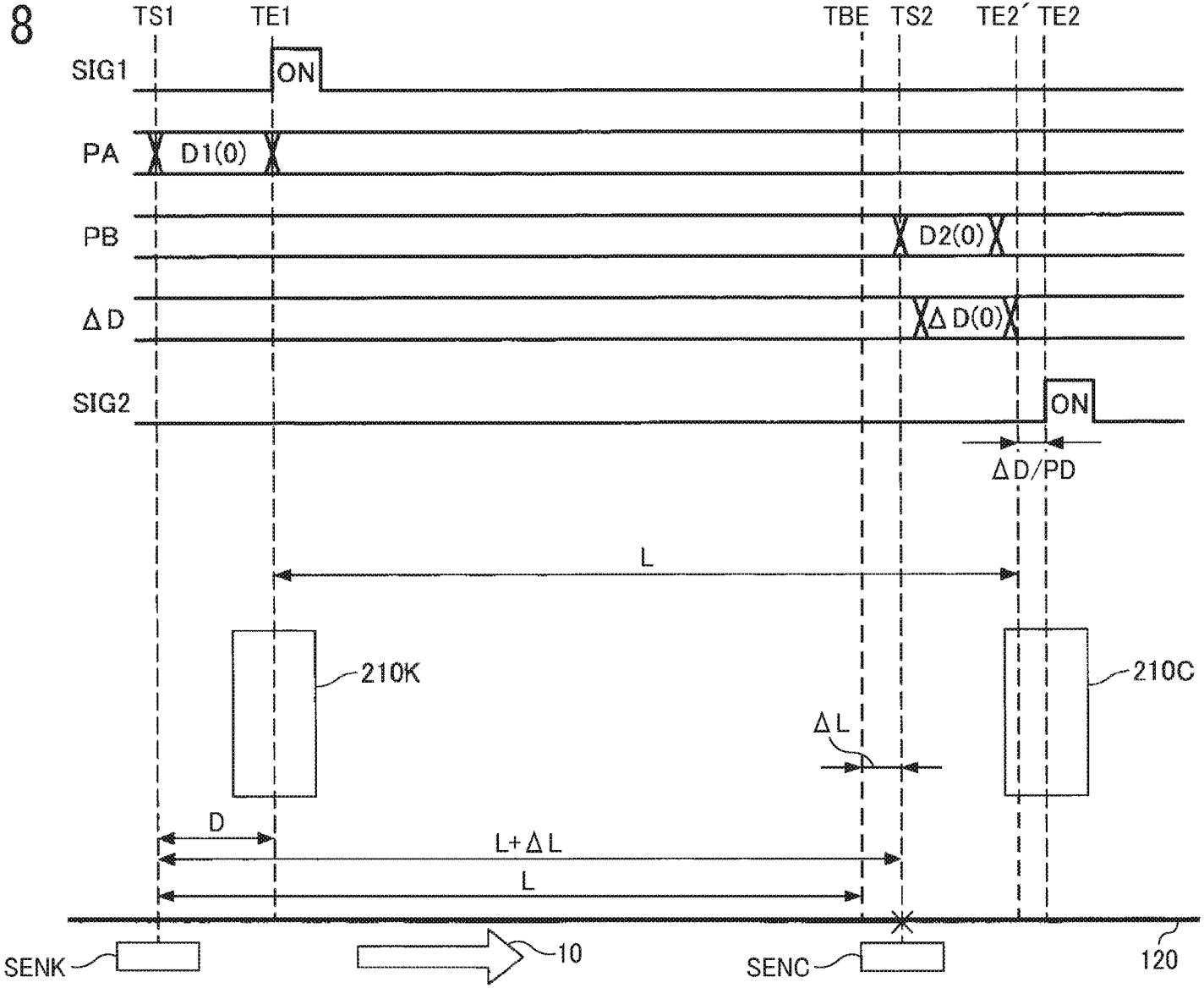
FIG. 18 is a chart illustrating detection by a sensor according to an embodiment.

FIG. 18 is a timing chart of control of operation timing of the liquid discharge head unit 210, together with a conceptual diagram.

In the illustrated example, the lateral axis represents the encoder pulse ENP output from the encoder sensor ENC. The amount of travel of the web 120 per one pulse of the encoder pulse ENP is referred to as a unit travel amount PD. The first acquisition timing TS1 is timing of acquisition of data by the sensor device SENK. First operation timing TE1 is timing of discharge of black ink. The second acquisition timing TS2 is timing of acquisition of data by the sensor device SENC for cyan, which is disposed between the liquid discharge head units 210K and 210C. The unadjusted timing TBE is timing of detection by the sensor device SENC when the adjustment illustrated in FIGS. 14A and 14B is not performed. Further, unadjusted operation timing TE2' is timing at which the cyan ink is to be discharged. A second operation timing TE2 is adjusted timing of discharge of cyan ink based on the image data generated by the sensor device SENC.

Note that, the position where the sensor device SENC performs detection is referred to as "detection position" (where the sensor OS is installed), and, in this example, a specified installation position of the sensor OS is at a distance D from the position where the ink discharged from the liquid discharge head unit 210C lands. Due to the attachment position error M, "detection position" is at an installation distance D−M from the liquid landing position.

Initially, the sensor device SENK performs detection at the first acquisition timing TS1 at which the encoder pulse ENP reaches the predetermined value. The first acquisition timing TS1 is earlier by the installation distance D/unit travel amount PD from the timing of ink discharge from the liquid discharge head unit 210K. At the first acquisition timing TS1, the sensor device SENK acquires the image data. In the illustrated example, the image data acquired at the first acquisition timing TS1 is represented by a first image signal PA. The image data here is equivalent to the first image data D1(*n*) at the position A illustrated in FIG. 7.

Subsequently, the liquid discharge apparatus 110 turns on the first signal SIG1 (illustrated in FIG. 7) to cause the liquid discharge head unit 210K to discharge liquid at the first operation timing TE1. The first operation timing TE1 is at timing when the encoder pulse ENP reaches a predetermined value. Note that the first operation timing TE1 can be counted from the first acquisition timing TS1.

At the second acquisition timing TS2, the sensor device SENC acquires the image data. The second acquisition timing TS2 is timing adjusted through the process illustrated in FIGS. 14A and 14B. The unadjusted timing TBE illustrated in FIG. 18 is timing of imaging by the sensor device SENC when the process illustrated in FIGS. 14A and 14B is not performed. In this example, it is known at steps S19 and S20 in FIGS. 14A and 14B that timing at which the number of pulses of the encoder pulse ENP reaches the number corresponding to the distance L between the head units is too early for the sensor device SENC to acquire image data relative to the position to be captured. Accordingly, the timing of data acquisition is adjusted to a time delayed by the number of pulses corresponding to the correction value ΔL. In other words, since the position of the sensor device SENC is deviated toward the liquid discharge head unit 210C by the attachment position error M, detection (data acquisition) is performed at the time delayed by the number of pulses corresponding to the correction value ΔL. In the illustrated example, the image data acquired at the second acquisition timing TS2 is represented by a second image signal PB, and the image data here is equivalent to the second image data D2(*n*) at the position B illustrated in FIG. 7. Subsequently, the calculator 53F performs cross-correlation operation of the image data D1(*n*) and the image data D2(*n*). In this manner, the liquid discharge apparatus 100 can calculate the deviation amount ΔD(0).

When the web 120 is conveyed in a state similar to the conveyance at the second conveyance speed, that is, 1) the roller is not thermally expanded; and 2) the web 120 does not slip on the roller, the number of the encoder pulse ENP output while a given portion of the web 120 travels from the liquid discharge head unit 210K to the liquid discharge head unit 210C is equivalent to the distance L.

By contrast, when the web 120 is conveyed at the first conveyance speed faster than the second conveyance speed, the possibility of slop between the web 120 and the roller is high.

Figure 19:
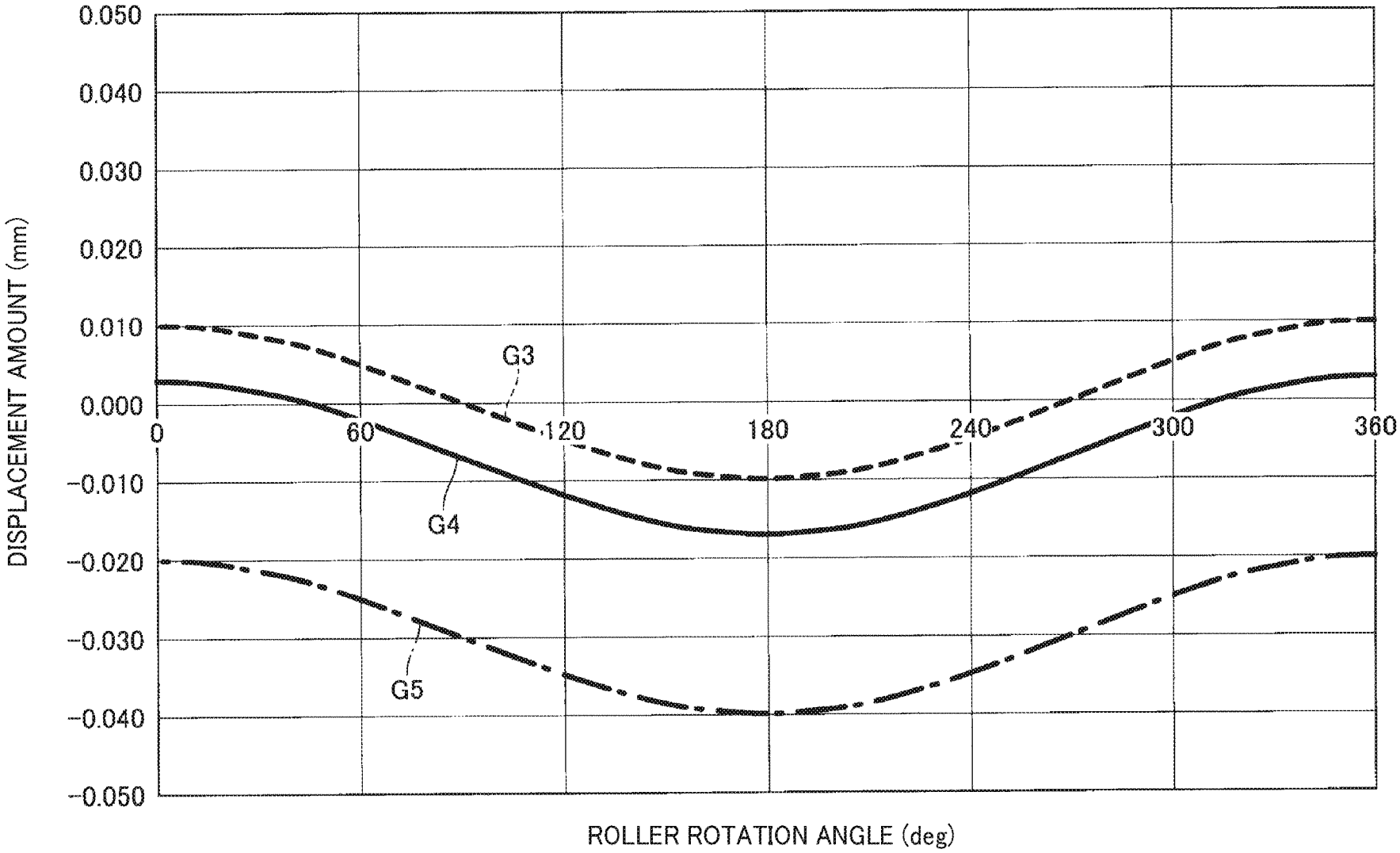
FIG. 19 is a graph illustrating an effect of roller eccentricity on deviations in ink landing position.

FIG. 19 is a graph illustrating an effect of roller eccentricity on deviations in ink landing position. The graphs illustrated in FIG. 19 represent examples of slip between the roller and the web 120, thermal expansion of the roller, and the eccentricity of the roller. In other words, the graphs in FIG. 19 represent, as the displacement on the vertical axis, the difference between the position of the web 120 calculated based on the encoder signal from the encoder ENC and the actual position of the web 120. In this example, the roller has an outer diameter of 60 mm and is made of aluminum.

A third graph G3 illustrated in FIG. 19 represents the displacement amount when the roller has an eccentricity of 0.01 mm. As indicated by the third graph G3, the period of the displacement amount caused by the roller eccentricity is typically synchronized with the rotation period of the roller. Further, the displacement amount caused by the eccentricity is typically proportional to the amount of eccentricity but does not accumulate.

A fourth graph G4 represents the displacement amount in the presence of roller eccentricity and thermal expansion. Note that the thermal expansion here is under a temperature change of −10° C.

A fifth graph G5 represents the displacement amount in the presence of roller eccentricity and slip between the web 120 and the roller. In this example, the slip between the web 120 and the roller is 0.1 percent.

In some cases, to reduce the meandering of the web 120, the web 120 is tensed in the conveyance direction 10. Causing tension on the web 120 can result in expansion and shrinkage of the web 120. The degree of expansion and shrinkage of the web 120 can vary depending on the thickness, width, amount of liquid applied thereto, or the like.

Referring back to FIG. 18, the calculator 53F initially calculates the deviation amount ΔD(0) based on the first image data D1(*n*) acquired at the first acquisition timing TS1 and the second image data D2(*n*) acquired at the second acquisition timing TS2. Then, based on the deviation amount ΔD(0) and the unit travel amount PD, the liquid discharge apparatus 110 changes the timing of discharge of liquid from the liquid discharge head unit 210C, that is, the second operation timing TE2.

In practice, after the number of pulses corresponding to the distance L has elapsed, the target position to which the liquid discharge head unit 210C is to discharge the liquid is located at a position shifted by the deviation amount ΔD(0) from an ideal position, due to the thermal expansion of the roller and slip. Accordingly, the timing of discharge of liquid from the liquid discharge head unit 210C is shifted by the amount expressed as ΔD(0)/PD. Therefore, the liquid discharge apparatus 110 changes the timing of discharge of liquid from the liquid discharge head unit 210C from the unadjusted operation timing TE2' to the second operation timing TE2 so that the liquid discharge head unit 210C discharges liquid to the position shifted by the deviation amount ΔD(0) from the ideal position.

Thus, the liquid discharge apparatus 110 changes, by the amount expressed as ΔD(0)/PD, the timing to turn on the second signal SIG2 from the unadjusted operation timing TE2' to the second operation timing TE2. Thus, since the operation timing is adjusted based on the he deviation amount ΔD(0) and the unit travel amount PD, the liquid discharge apparatus 110 can improve the accuracy in liquid landing position in the conveyance direction even under the presence of the roller thermal expansion, slip between the web and the roller, and the like.

Additionally, in the liquid discharge apparatus 110, respective ideal conveyance speeds can be preliminarily set for operation modes. The ideal conveyance speed mentioned here is the conveyance speed in a state without the thermal expansion or the like.

The descriptions above concern determination of the operation timing based on the encoder pulse ENP. Alternatively, the operation timing at which liquid is discharged can be determined based on direct calculation based on the displacement amount, travel speed V of the web 120, and installation distance D of the sensors OS. The processing above can be performed in parallel. That is, although the first image data D1 is acquired only once in FIG. 18, in practice, the first image data D1 can be acquired a plurality of number of times during the period in FIG. 18, and the corresponding second image data D2 can be acquired after the respective positions of the plurality of first image data D1 have moved by the distance expressed as L+ΔL.

Fluctuations of Web in Orthogonal Direction During Operation

Figure 20A:
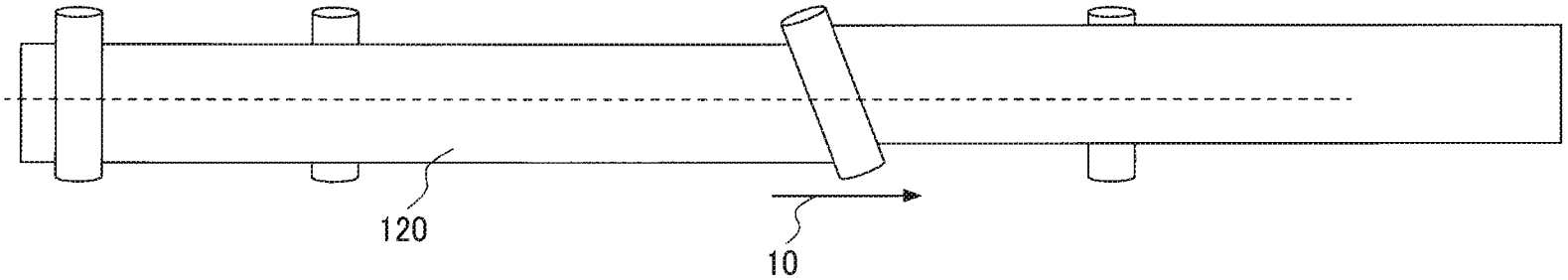
FIGS. 20A and 20B are plan view of a recording medium being conveyed.
Figure 20B:
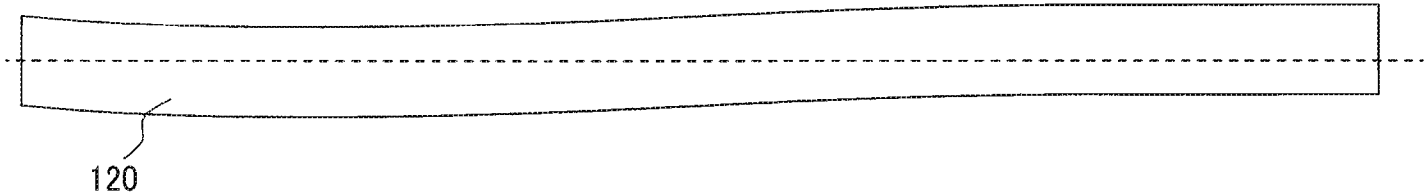

Descriptions are given below of displacement of the web 120 in the orthogonal direction 20, with reference to FIGS. 20A and 20B, which are plan views of the web 120 being conveyed. In FIG. 20A, the web 120 is conveyed in the conveyance direction 10. While the web 120 is conveyed by the rollers (such as the rollers 230, CR1, and CR2 in FIG. 2), the position of the web 120 may fluctuate in the orthogonal direction 20 as illustrated in FIG. 20B. That is, the web 120 may meander as illustrated in FIG. 20B.

Note that, the roller is disposed oblique to the conveyance direction 10 in the illustrated example. In the drawing, the obliqueness is exaggerated, and the degree of obliqueness may be smaller than the degree illustrated.

The fluctuation of the position of the web 120 in the orthogonal direction 20 (hereinafter "orthogonal position of the web 120"), that is, the meandering of the web 120, is caused by eccentricity of a conveyance roller (the driving roller in particular), misalignment, or tearing of the web 120 by a blade. When the web 120 is relatively narrow in the orthogonal direction 20, for example, thermal expansion of the roller affects fluctuation of the web 120 in the orthogonal direction 20.

For example, when vibration is caused by eccentricity of the roller or cutting with a blade, the web 120 can meander as illustrated. Additionally, when the cutting with the blade is uneven, meandering can be also caused by a physical property of the web 120, that is, the shape of the web 120 after the cutting.

Figure 21:
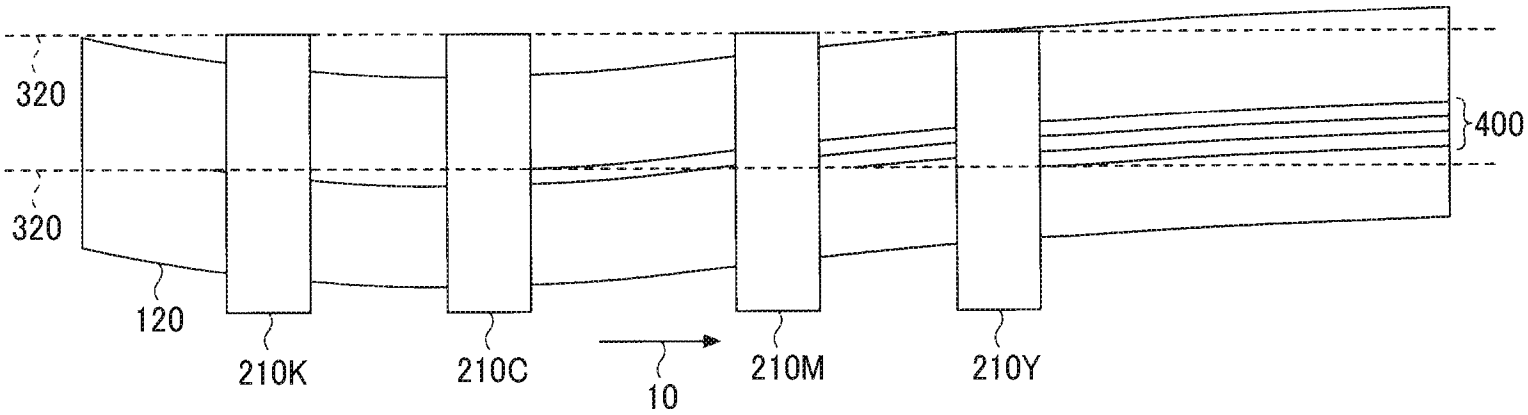
FIG. 21 is a plan view of the recording medium being conveyed and illustrates creation of an image out of color registration.

Descriptions are given below of a cause of misalignment in color superimposition (out of color registration) with reference to FIG. 21. Due to fluctuations (meandering illustrated in FIG. 20B) of the web 120 (the recording medium) in the orthogonal direction 20, misalignment in color superimposition is likely to occur.

Specifically, to form a multicolor image on a recording medium using a plurality of colors, the liquid discharge apparatus 110 superimposes a plurality of different color inks discharged from the liquid discharge head units 210, through so-called color plane, on the web 120.

As illustrated in FIG. 20B, the web 120 can fluctuate in position and meanders, for example, with reference to lines 320. Assuming that the liquid discharge head units 210 discharge respective inks to an identical portion (i.e., an intended droplet landing position) on the web 120 in this state, a portion 400 out of color registration is created since the intended droplet landing position fluctuates in the orthogonal direction 20 while the web 120 meanders between the liquid discharge head units 210. The portion 400 out of color registration is creased as the position of a line or the like, drawn by the respective inks discharged from the liquid discharge head units 210, shakes in the orthogonal direction 20. The portion 400 out of color registration degrades the quality of the image on the web 120.

Position Adjustment of Heat Unit in Orthogonal Direction

The position in the orthogonal direction 20, the speed, or the calculated travel amount can be acquired from the result of calculation by the calculator 53F as described above. The acquisition of the first image data D1 and the second image data D2 used in calculation by the calculator 53F are image data similar to those used in the adjustment of operation timing, that is, image data acquired at the timing adjusted in the process from S13 to S21 in FIGS. 14A and 14B.

Figure 22:
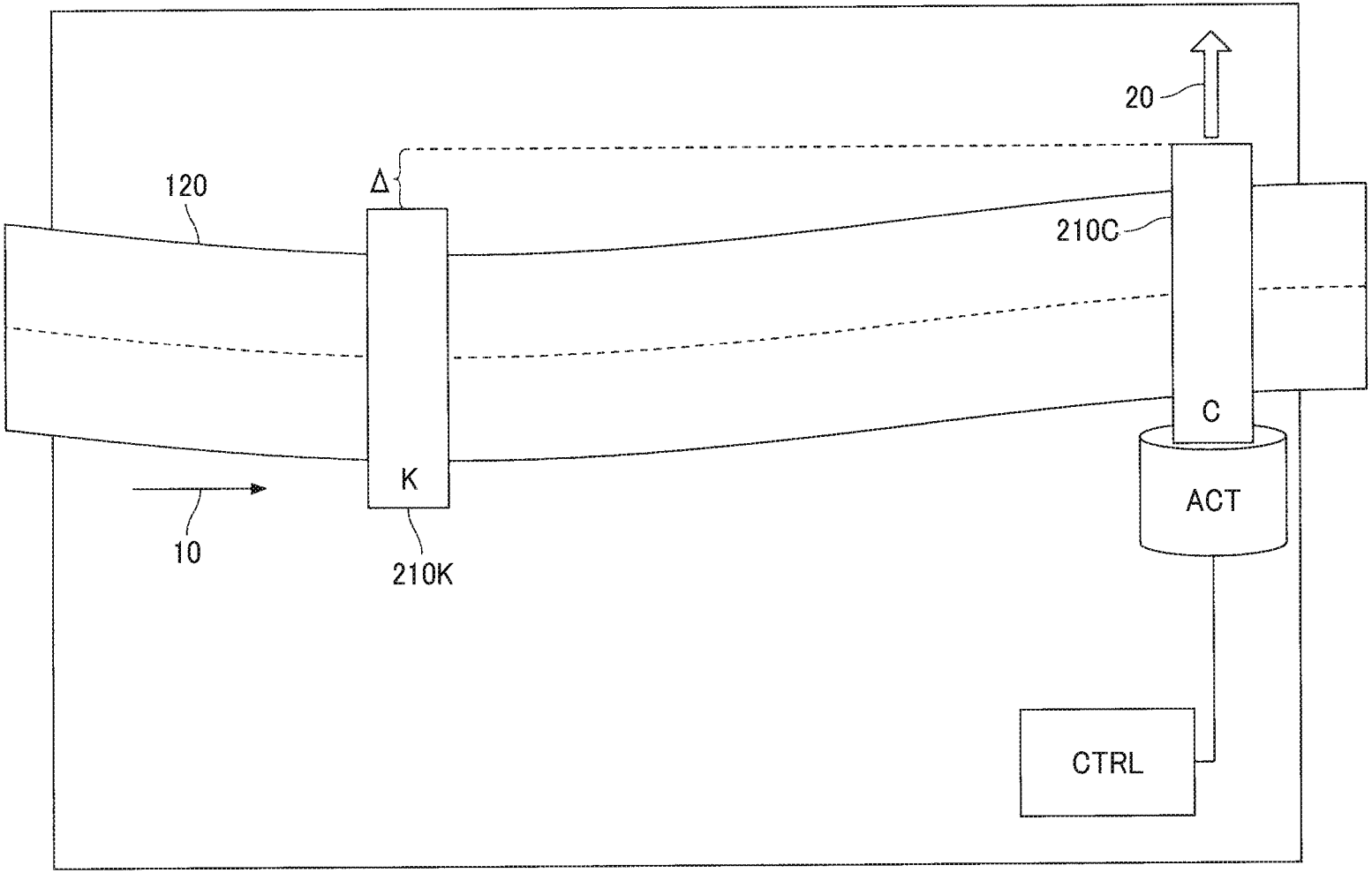
FIG. 22 is a schematic diagram of an example mechanism to move the liquid discharge head unit of the liquid discharge apparatus, according to an embodiment.

FIG. 22 is a schematic diagram of an example mechanism to move the liquid discharge head unit 210 (i.e., head moving device) according to the present embodiment. For example, the hardware configuration illustrated in this drawing implements the function of the head moving unit 110F80 illustrated in FIG. 7. In the drawing, the mechanism to move the liquid discharge head unit 210C is illustrated.

In the illustrated example, the actuator ACT such as a linear actuator is coupled to the liquid discharge head unit 210C to move the liquid discharge head unit 210C. To the actuator ACT, the actuator controller CTRL to control the actuator ACT is connected.

The actuator ACT is, for example, a linear actuator or a motor. The actuator ACT can include a control circuit, a power circuit, and a mechanical component.

To the actuator controller CTRL, the detection result calculated by the calculator 53F, such as the position of the web 120 in the orthogonal direction 20, the calculated travel amount, or the travel speed, is input. The actuator controller CTRL drives the actuator ACT to move the liquid discharge head unit 210C to compensate for the displacement of the web 120 indicated by the detection result. Alternatively, instead of the detection result, a control signal to drive the actuator ACT or timing to move the actuator ACT can be input to the actuator controller CTRL.

For example, when the detection result indicates that the amount of displacement is "Δ" (hereinafter "displacement Δ"), the actuator controller CTRL moves the liquid discharge head unit 210C to compensate for the displacement Δ in the orthogonal direction 20.

Since each liquid discharge head unit 210 can be moved during the operation by the head moving unit 110F80 implemented by the illustrated mechanism, the liquid discharge head unit 210 can be moved to follow the conveyed object even when the position of the conveyed object fluctuates (i.e., meanders) in the orthogonal direction 20 during the operation. Thus, accuracy in operation improves.

Additionally, as the timing of acquisition of data is adjusted, adverse effects caused by disturbance such as the attachment position error M can be reduced. As the adverse effects caused by disturbance decrease, the detection area detectable by the detecting unit 52B can become wider, for example, as illustrated in FIG. 16. Further, in the detection area, the detecting unit 52B can detect the position and the like of the conveyed object. When the detection result is acquired in a wide area, the liquid discharge apparatus 110 can improve the accuracy of the operation by the head units.

In the above-described embodiment, for each liquid discharge head unit 210, the liquid discharge apparatus 110 calculates the detection result such as the position of the web 120 in at least one of the conveyance direction 10 and the orthogonal direction 20, travel speed, or the calculated travel amount.

Based on the detection result, the liquid discharge apparatus 110 can determine the timing of discharge of liquid for each liquid discharge head unit 210. Accordingly, the liquid discharge apparatus 110 can suppress the deviation in the liquid landing position in the conveyance direction 10.

Additionally, since the position of the web 120 can be directly detected, adverse effects of roller thermal expansion or the like can be canceled accurately. When the detection is performed close to the liquid discharge head unit 210, adverse effects of expansion and shrinkage of the web or the like can be canceled accurately.

When the adverse effects caused by eccentricity of the roller, thermal expansion of the roller, slip between the recording medium and the roller, expansion and shrink of the web 120, and a combination thereof are suppressed, the accuracy in liquid landing position can improve.

In image formation with liquid discharged onto a recording medium, as the accuracy in liquid landing position improves, misalignment in color superimposition is suppressed, improving image quality.

Further, the detecting units (52A or 52B illustrated in FIG. 7) can calculate the detection result including at least one of the position, travel speed, and the calculated travel amount, for each liquid discharge head unit 210, based on the pattern (surface data) of the conveyed object, detected at, at least two different time points. With this configuration, the timing of discharge of liquid from each liquid discharge head unit 210 can be controlled based on the detection result generated for that liquid discharge head unit 210. Accordingly, deviation in liquid landing position can be canceled accurately.

Note that detection of position of the recording medium or the like can be reliable when the result generated by the measurement unit 110F20 is used in addition to the detection result.

During the adjustment, preferably, the conveyed object is conveyed at a low speed such as the second conveyance speed described above. Before the adjustment, the data acquisition is performed, for example, at the unadjusted timing TBE illustrated in FIG. 15. For the deviation calculator 110F50 to calculate the deviation amount ΔD relative to the ideal sensor interval, the image data (the second image data D2) acquired at the unadjusted timing TBE should include a given portion of the conveyed object captured on the upstream side so that the detecting unit 52B can detect that portion. When the conveyance speed is low, it is highly possible that the image data acquired at the unadjusted timing TB includes the given portion captured on the upstream side. That is, with the second conveyance speed, the adjustment is facilitated.

Variations

Note that, alternatively, the detecting unit 52B can perform imaging twice with an identical sensor and compare the images acquired by the first imaging and second imaging, to output the detection result indicating at least one of the position, speed of movement, and amount of movement of the web 120.

One or more of aspects of this disclosure can adapt to a conveyance system such as a liquid discharge system including at least one liquid discharge apparatus. For example, the liquid discharge head unit 210K and the liquid discharge head unit 210C are housed in a case of one apparatus, and the liquid discharge head unit 210M and the liquid discharge head unit 210Y are housed in a case of another apparatus. Then, the liquid discharge system includes the two apparatuses.

Further, one or more of aspects of this disclosure can adapt to a liquid discharge apparatus or a liquid discharge system to discharge liquid other than ink. For example, the liquid is a recording liquid of another type or a fixing solution. In other words, aspects of this disclosure can adapt to a liquid discharge apparatus to discharge liquid other than ink and a system including such a liquid discharge apparatus.

The liquid discharge apparatus (or system) to which at least one aspect of this disclosure is applicable is not limited to apparatuses to form images. The image (an article) produced can be, for example, a three-dimensional object (a 3D-fabricated object).

The conveyed object is not limited to recording media such as paper sheets but can be any material to which liquid adheres, even temporarily. Examples of the material to which liquid adheres include paper, thread, fiber, cloth, leather, metal, plastic, glass, wood, ceramics, and a combination thereof.

Further, aspects of this disclosure can adapt to any apparatus to perform an operation or processing on a conveyed object, using a line head unit including heads lined in a direction orthogonal to the direction of conveyance of the conveyed object.

Variation 1

A single support can double as the first and second supports. An example configuration of the first and second supports is described below.

Figure 23:
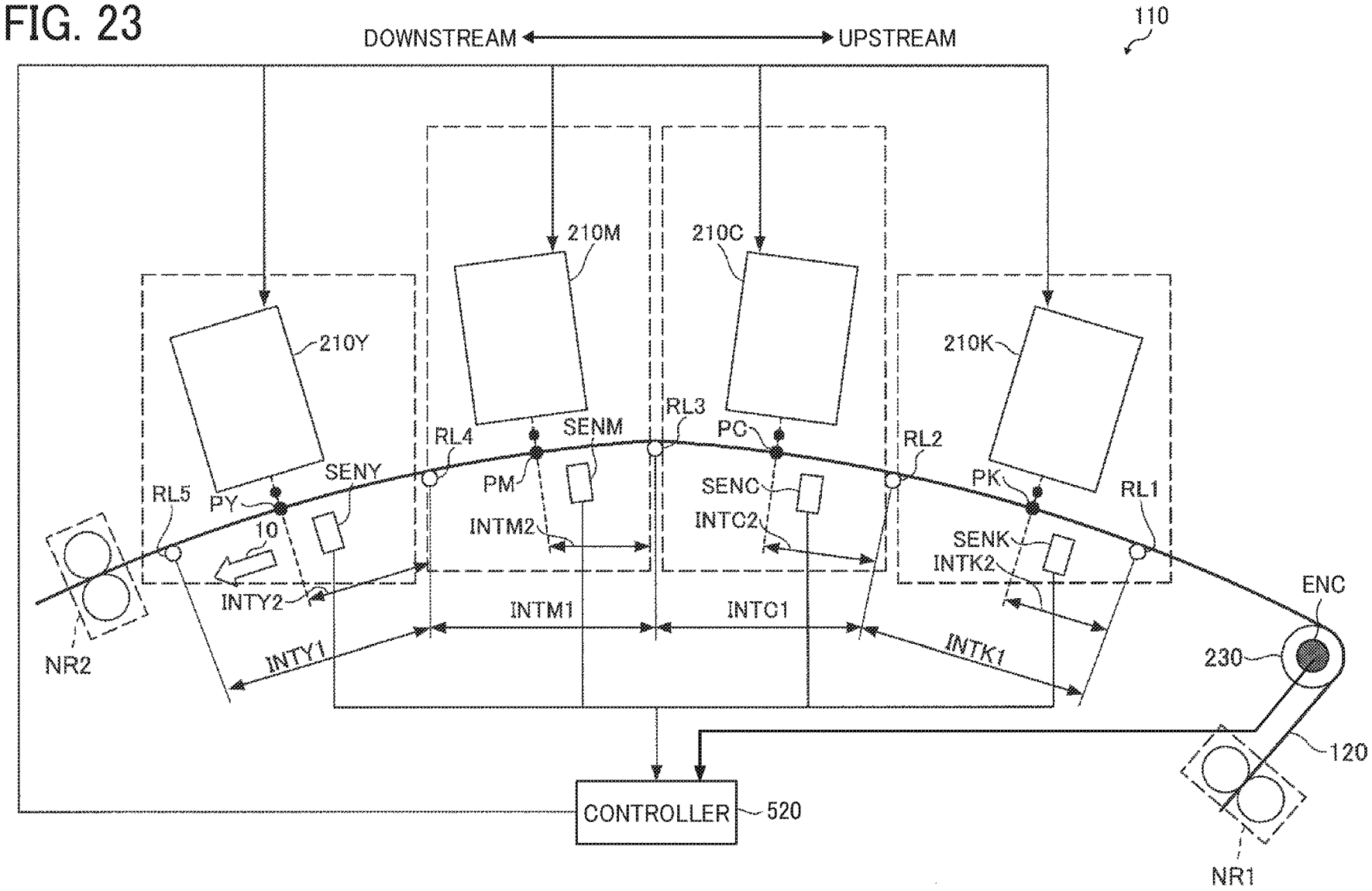
FIG. 23 is a schematic view of a liquid discharge apparatus according to Variation 1.

FIG. 23 is a schematic view of a liquid discharge apparatus according to Variation 1. This configuration differs from the configuration illustrated in FIG. 2 regarding the locations of the first support and the second support. The liquid discharge apparatus 110 illustrated in this drawing includes supports RL1, RL2, RL3, RL4, and RL5, serving as the first and second supports. In other words, one support can double as the second support (e.g., the conveyance roller CR2K in FIG. 2) disposed upstream from the downstream one of adjacent two liquid discharge head units and the first support (e.g., the conveyance roller CR1C in FIG. 2) disposed upstream from the upstream one of the adjacent two liquid discharge head units. Note that, the support according to the modification, which doubles as the first and second supports, can be either a roller or a curved plate.

Variation 2

For example, the conveyance device according to this disclosure can be a device to perform operation, such as reading, relative to the conveyed object.

Figure 24:
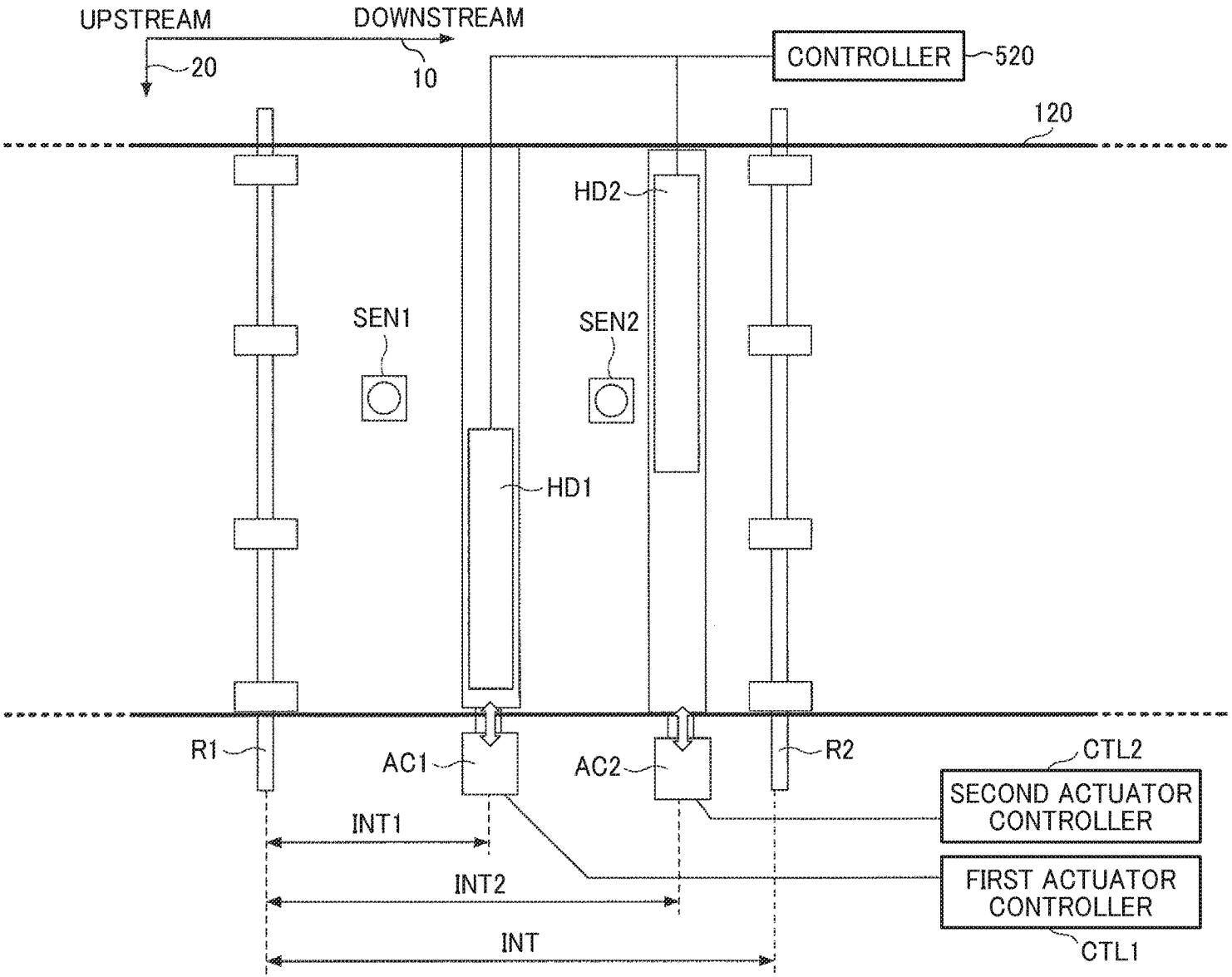
FIG. 24 is a schematic view of a liquid discharge apparatus according to Variation 2.

FIG. 24 is a schematic view of a conveyance device according to Variation 2. In the example described below, the web 120 is conveyed from the left to the right in the drawing.

In this example, the conveyance device includes a head unit including a contact image sensor (CIS) head.

The head unit includes at least one CIS head. When head unit includes a plurality of CIS heads, the CIS heads are arranged in the orthogonal direction 20. In the illustrated example, the conveyance device includes two head units HD1 and HD2 (also collectively "head units HD"). The number of head units is not limited two but can be three or more.

As illustrated in FIG. 24, the head units HD1 and HD2 each include at least one CIS head. Although a description is made below of a configuration in which each head unit HD includes the one CIS head, alternatively, a plurality of CIS heads can be arranged in a zigzag manner, for example, with each two CIS heads staggered.

The head units HD1 and HD2 construct a scanner to read an image on the surface of the web 120 and output image data representing the image thus read. The conveyance device can combine pieces of image data output from the head units HD together to generate an image combined in the orthogonal direction 20.

The conveyance device illustrated in FIG. 24 includes the controller 520, and the first and second actuator controllers CTL1 and CTL2. The controller 520 and the first and second actuator controllers CTL1 and CTL2 are information processing apparatuses and, specifically, have hardware including a processor, a control device, a memory device, and an interface implemented by a CPU, an electronic circuit, or a combination thereof. Note that the controller 520 and the actuator controllers CTL1 and CTL2 can be implemented by either a plurality of devices or a single device.

The head units are provided with the first sensor device SEN1 and the second sensor device SEN2 (also collectively "sensor devices SEN"), respectively. The conveyance device detects, with the sensor devices SEN, the surface data of the web 120 and detects at least one of the relative position, speed of movement, and the amount of travel of the web 120 among a plurality of detection results.

For the two head units HD1 and HD2, a plurality of rollers is provided. As illustrated in the drawing, for example, a first roller R1 and a second roller R2 are respectively disposed upstream and downstream from the two head units HD1 and HD2.

The sensor device SEN disposed in an inter-roller range INT between the first and second rollers R1 and R2 can detect the web 120 at a position close to the operation position. Since the travel speed is relatively stable in the inter-roller range INT, the conveyance device can accurately detect at least one of the relative position, speed of movement, and the amount of movement of the conveyed object among a plurality of detection results, in the conveyance direction, the orthogonal direction, or both.

Preferably, in each inter-roller ranges INT1, the sensor device SEN is disposed closer to the first roller R1 than the operation position is. That is, preferably, the sensor device SEN performs the detection at a position upstream from the operation position of the head unit HD. In the illustrated example, the first sensor device SEN1 is preferably disposed between the operation position of the head unit HD1 and the first roller R1, that is, in a first upstream range INT1 in the drawing.

Similarly, the second sensor device SEN2 is preferably disposed between the operation position of the head unit HD2 and the first roller R1, that is, in a second upstream range INT2 in the drawing.

When the first and second sensor devices SEN1 and SEN2 are disposed in the first and second upstream ranges INT1 and INT2, respectively, the conveyance device can detect the conveyed object with a high accuracy. The sensor devices SEN disposed upstream from the operation position of the head unit HD can detect the surface data of the conveyed object at a position upstream from the operation position. Then, based on the detection result, the conveyance device can calculate the timing of operation by the head unit HD, the amount by which the head unit HD is to be moved, or both in at least one of the orthogonal direction 20 and the conveyance direction 10. In other words, in a period from when the position of a given portion of the web 120 (conveyed object) is detected on the upstream side to when the detected portion of the web 120 reaches the operation position, the operation timing is calculated or the head unit HD is moved. Therefore, the conveyance device can change the operation position with high accuracy.

If the sensor device SEN is disposed directly below the head unit HD, in some cases, depending on the calculation of operation timing or time for moving the head unit HD, the start of operation may be delayed. Accordingly, disposing the sensor device SEN upstream from the operation position can minimize the delay in operation of the head unit. Additionally, there may be a restriction on disposing the sensor device SEN adjacent to the operation position, that is, directly below the head unit HD. Accordingly, the location of sensor device is preferably closer to the first roller R1 than the operation position, that is, upstream from the ink operation position.

The web 120 may be irradiated with light in both of the operation by the head unit HD and detection by the sensor device SEN. In particular, when the web 120 has a high degree of transparency, the light for one of the operation and the detection may disturb the other. In such a case, disposing the sensor device SEN and the head unit HD on an identical optical axis is undesirable.

By contrast, when the transparency of the web 120 is lower, the sensor device SEN can be directly below the head unit HD. In the illustrated example, the position directly below the head unit HD is on the back side of the operation position. In other words, in some cases, the operation position and the location of sensor device are almost identical in the conveyance direction 10, and the operation is made on one side (e.g., front side) of the web 120 and the other side of the web 120 (e.g., back side) is detected by the sensor device SEN.

The sensor device SEN disposed directly below the head unit HD can accurately detect the amount of movement of the conveyed object directly below the head unit HD. Therefore, in a case where the light for one of the operation and the detection does not disturb the other and the speed of control action is relatively fast, the sensor device SEN is preferably disposed closer to the position directly below the head unit HD. However, the location of sensor device is not limited to a position directly below the head unit HD, and similar calculation is feasible when the sensor device SEN is disposed otherwise.

Alternatively, in a configuration in which error is tolerable, the location of sensor device can be almost directly below the head unit HD, or downstream from the position directly below the head unit HD in the inter-roller range INT.

Variation 3

The liquid discharge apparatus 110 can convey a belt as the conveyed object.

Figure 25:
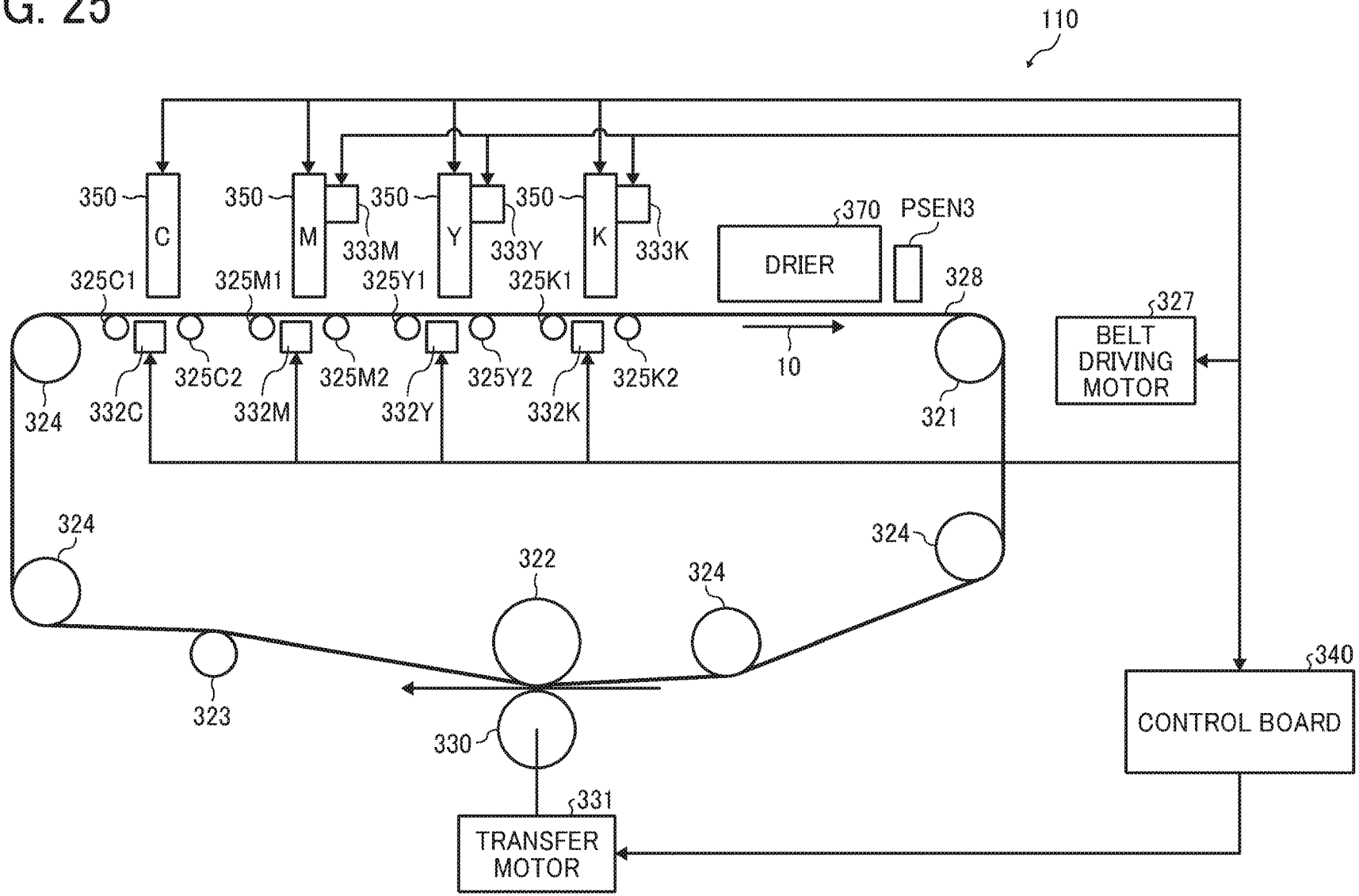
FIG. 25 is a schematic view of a liquid discharge apparatus according to Variation 3.

FIG. 25 is a schematic view of a liquid discharge apparatus according to Variation 3. In this example, head units 350C, 350M, 350Y, and 350K discharge ink droplets to form an image on the outer side of the loop of a transfer belt 328. The head units 350C, 350M, 350Y, and 350K are also collectively referred to as head units 350.

A drier 370 dries an image formed on the transfer belt 328 into a film.

Then, at a transfer position where the transfer belt 328 faces a transfer roller 330, the liquid discharge apparatus 110 transfers the image in the form of film, conveyed on the transfer belt 328, onto a sheet P.

Additionally, a cleaning roller 323 cleans the surface of the transfer belt 328 after the transfer.

In the liquid discharge apparatus 110 in this variation, the head units 350C, 350M, 350Y, and 350K, the drier 370, the cleaning roller 323, and the transfer roller 330 are disposed around the transfer belt 328.

In this example, the transfer belt 328 is stretched taut around a driving roller 321, an opposing roller 322 (a transfer-backup roller), four shape-keeping rollers 324, and eight support rollers 325C1, 352C2, 325M1, 325M2, 325Y1, 325Y2, 325K1, and 325K2. As the driving roller 321 rotates driven by a belt driving motor 327, the transfer belt 328 rotates in the conveyance direction 10.

The eight support rollers 325C1, 325C2, 325M1, 325M2, 325Y1, 325Y2, 325K1, and 325K2, disposed opposite the head units 350, keep the transfer belt 328 taut when the head units 350C, 350M, 350Y, and 350K discharge ink droplets. A transfer motor 331 drives the transfer roller 330.

Further, a sensor device 332C is disposed between the support rollers 325C1 and 325C2 and upstream from the ink discharge position of the head unit 350C in the conveyance direction 10 in which the transfer belt 328 rotates. The sensor device 332C includes a speckle sensor, which is an example to acquire data of the transfer belt 328. Similar to the position of the sensor device 332C relative to the support rollers 325C1 and 325C2 and the head unit 350C, the sensor device 332M is disposed for the head unit 350M.

For the head units 350M, 350Y, and 350K, actuators 333M, 333Y, and 333K are provided, respectively. The actuator 333M moves the head unit 350M in the direction orthogonal to the conveyance direction 10 in which the transfer belt 328 rotates. Similarly, the actuators 333Y and 333K move the head units 350Y and 350K, respectively, in the direction orthogonal to the conveyance direction 10 in which the transfer belt 328 rotates.

A control board 340 detects the amount of movement of the transfer belt 328 in the direction orthogonal to the conveyance direction 10 and that in the conveyance direction, based on the image data acquired from the sensor devices 332C, 332M, 332Y, and 332K. Additionally, according to the amount of movement of the transfer belt 328 in the orthogonal direction, the control board 340 controls the actuators 333M, 333Y, and 333K to move the head units 350M, 350Y, and 350K in the orthogonal direction. Additionally, according to the amount of movement of the transfer belt 328 in the conveyance direction 10, the control board 340 controls the timing of liquid discharge from the head units 350M, 350Y, and 350K.

The control board 340 outputs driving signals to the belt driving motor 327 and the transfer motor 331.

Variation 3 can attain the following effects.

When the transfer belt 328 moves in the direction orthogonal to the direction in which the transfer belt 328 is driven by the driving roller 321 during driving of the transfer belt 328, the liquid discharge apparatus 110 can move the head units 350M, 350Y, and 350K in the orthogonal direction, corresponding to the amount of movement detected. Accordingly, the liquid discharge apparatus 110 can form a high-quality image on the transfer belt 328.

When the amount by which the transfer belt 328 rotates in the direction driven by the driving roller 321 is different from a supposed amount, the liquid discharge apparatus 110 can change the timing of liquid discharge from the head units 350M, 350Y, and 350K in response to the amount of rotation detected. Accordingly, the liquid discharge apparatus 110 can form a high-quality image on the transfer belt 328.

In the above-described example, the amount of movement of the transfer belt 328 in the conveyance direction 10 and that in the direction orthogonal thereto are calculated based on the image data acquired from the sensor devices 332C, 332M, 332Y, and 332K. Alternatively, the amount of movement in only one of those directions can be calculated.

Although the head unit 350C does not include an actuator in the above-described example, alternatively, an actuator can be provided. Then, the head unit 350C is moved in the direction orthogonal to the conveyance direction 10, thereby adjusting the position of the head unit 350C in the orthogonal direction at the time of image transfer from the transfer belt 328 onto the sheet P.

Although a plurality of head units is used to form an image on the transfer belt 328 in the example described above, alternatively, the operation described above can adopt to forming an image using one head unit.

For example, aspects of this disclosure can adapt to a conveyance apparatus that conveys a substrate (conveyed object) and includes a laser head to perform laser patterning on the substrate. A plurality of such laser heads can be lined in the direction orthogonal to the direction of conveyance of the substrate. The conveyance device detects the position of the substrate and moves the head unit based on the detection result. In this case, the position at which the laser lands on the substrate is the operation position of the head.

The number of the head units is not necessarily two or more. Aspects of this disclosure can adapt to a device configured to keep performing processing at a reference position, on a conveyed object.

Further, one or more of aspects of this disclosure can be embodied as a method performed by a computer of a conveyance device, an information processing apparatus, or the combination thereof to cause the apparatus to discharge liquid, and at least a portion of the method can be implemented by a program. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

What is claimed is:

1. A conveyance device comprising:

a conveyor to convey a conveyed object in a conveyance direction;

head units to perform image formation on the conveyed object being conveyed at a first conveyance speed in the conveyance direction;

sensors to acquire data of the conveyed object, the sensors corresponding with the head units and including at least an upstream sensor and a downstream sensor in the conveyance direction;

a gauge to output a measured travel amount of the conveyed object; and a controller configured to direct the conveyor to convey the conveyed object at the first conveyance speed for calculating a distance between the upstream sensor and the downstream sensor, and to direct the conveyor to convey the conveyed object at a second conveyance speed lower than the first conveyance speed for adjusting a timing of acquiring the data at the downstream sensor, wherein the adjusting of the timing is based on the calculated distance between the upstream sensor and the downstream sensor and the measured travel amount of the conveyed object being conveyed at the second conveyance speed.

2. The conveyance device according to claim 1, wherein the gauge is an encoder, and wherein the measured travel amount is represented by a pulse output from the encoder.

3. The conveyance device according claim 1, wherein the sensors include an optical sensor.

4. The conveyance device according to claim 1, wherein the conveyed object is a continuous sheet extending in the conveyance direction.

5. The conveyance device according to claim 1, wherein the controller includes a deviation calculator configured to calculate a deviation amount from a reference amount, based on the calculated distance and the measured travel amount.

6. The conveyance device according to claim 5, wherein the deviation calculator is configured to calculate a plurality of deviation amounts and calculate an average deviation of the plurality of deviation amounts, and to adjust the timing of acquiring the data based on the average deviation.

7. The conveyance device according to claim 1, further comprising:

a first support disposed upstream from a head unit in the conveyance direction; and a second support disposed downstream from the head unit in the conveyance direction, wherein a sensor is disposed between the first support and the second support.

8. The conveyance device according to claim 7, wherein the sensor is disposed between the head unit and the first support in the conveyance direction.

9. The conveyance device according to claim 1, wherein the data represents a pattern of the conveyed object.

10. The conveyance device according to claim 9, wherein the controller is configured to calculate the distance between the upstream sensor and the downstream sensor based on the pattern acquired for at least two different timings.

11. The conveyance device according to claim 9, wherein the pattern is generated by interference of reflected light on a rugged shape of the conveyed object, and wherein the controller is configured to calculate the distance based on an image of the pattern.

12. The conveyance device according to claim 1, wherein the controller includes a head controller configured to control, based on the calculated distance, the image formation of at least one head unit on the conveyed object, and wherein the at least one processor is configured to determine, based on the calculated distance, a timing of the image formation by the at least one head unit, performed on the conveyed object being conveyed at the first conveyance speed.

13. The conveyance device according to claim 12, wherein the head controller is configured to control the at least one head unit based on the measured travel amount and the calculated distance.

14. A conveyance system comprising:

a plurality of conveyance devices, each of which includes:

a conveyor to convey a conveyed object in a conveyance direction;

head units to perform image formation on the conveyed object being conveyed at a first conveyance speed in the conveyance direction;

sensors to acquire data of the conveyed object, the sensors corresponding with the head units and including at least an upstream sensor and a downstream sensor in the conveyance direction;

a gauge to output a measured travel amount of the conveyed object; and a controller configured to direct the conveyor to convey the conveyed object at the first conveyance speed for calculating a distance between the upstream sensor and the downstream sensor, and to direct the conveyor to convey the conveyed object at a second conveyance speed lower than the first conveyance speed for adjusting a timing of acquiring the data at the downstream sensor, wherein the adjusting of the timing is based on the calculated distance between the upstream sensor and the downstream sensor and the measured travel amount of the conveyed object being conveyed at the second conveyance speed.

15. A method for controlling head units to perform image formation on a conveyed object being conveyed in a conveyance direction, the method comprising:

printing, with the head units, on the conveyed object being conveyed at a first conveyance speed in the conveyance direction;

acquiring data of the conveyed object with sensors corresponding with the head units and including at least an upstream sensor and a downstream sensor in the conveyance direction;

directing conveyance the conveyed object at the first conveyance speed for calculating a distance between the upstream sensor and the downstream sensor; and directing the conveyor to convey the conveyed object at a second conveyance speed lower than the first conveyance speed for adjusting a timing of acquiring the data at the downstream sensor, wherein the adjusting of the timing is based on the calculated distance between the upstream sensor and the downstream sensor and a measured travel amount of the conveyed object being conveyed at the second conveyance speed.

* * * * *